US011204581B2

(12) United States Patent
Seki

(10) Patent No.: US 11,204,581 B2
(45) Date of Patent: Dec. 21, 2021

(54) IMAGE FORMING APPARATUS WITH OPTICAL SCANNING DEVICE WINDOW CLEANING MEMBER AND CONTROL THEREOF

(71) Applicant: CANON KABUSHIKI KAISHA, Tokyo (JP)

(72) Inventor: Hirotaka Seki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/674,513

(22) Filed: Nov. 5, 2019

(65) Prior Publication Data

US 2020/0150571 A1 May 14, 2020

(30) Foreign Application Priority Data

Nov. 14, 2018 (JP) ..... JP2018-213850

(51) Int. Cl.

| | |
|---|---|
| ***G03G 21/16*** | (2006.01) |
| ***G03G 15/01*** | (2006.01) |
| ***G03G 15/00*** | (2006.01) |
| ***G03G 15/04*** | (2006.01) |

(52) U.S. Cl.

CPC ..... *G03G 21/1666* (2013.01); *G03G 15/011* (2013.01); *G03G 15/04036* (2013.01); *G03G 15/50* (2013.01); *G03G 15/5016* (2013.01); *G03G 2221/0005* (2013.01); *G03G 2221/0026* (2013.01); *G03G 2221/0063* (2013.01); *G03G 2221/0089* (2013.01); *G03G 2221/1636* (2013.01)

(58) Field of Classification Search

CPC ..... G03G 15/011; G03G 15/04036; G03G 15/50; G03G 15/5016; G03G 21/1666; G03G 2221/0005; G03G 2221/0026; G03G 2221/0063; G03G 2221/0089; G03G 2221/1636

See application file for complete search history.

(56) References Cited

U.S. PATENT DOCUMENTS

| | | | | |
|---|---|---|---|---|
| 2007/0053710 | A1* | 3/2007 | Shibaki | G03G 15/50 399/81 |
| 2012/0189360 | A1* | 7/2012 | Shirai | G03G 15/2025 399/327 |
| 2014/0112676 | A1* | 4/2014 | Mori | G03G 15/55 399/49 |
| 2016/0026107 | A1* | 1/2016 | Takahashi | G03G 15/0877 318/452 |
| 2016/0033923 | A1* | 2/2016 | Sumikura | G03G 15/04 399/98 |

FOREIGN PATENT DOCUMENTS

| | | | | |
|---|---|---|---|---|
| EP | 0318951 | A2 * | 6/1989 | G03G 15/0258 |
| JP | 2004-101607 | A | 4/2004 | |
| JP | 2005-215295 | A | 8/2005 | |
| JP | 2010-151959 | A | 7/2010 | |
| JP | 2016-31467 | A | 3/2016 | |
| JP | 2018-054848 | A | 4/2018 | |

* cited by examiner

*Primary Examiner* — Joseph S Wong

(74) *Attorney, Agent, or Firm* — Canon U.S.A., Inc. IP Division

(57) ABSTRACT

An image forming apparatus resets a count value retained by a counter if a cleaning sequence is executed based on an execution instruction accepted from an operator via an operation unit or when the count value for counting the number of image-formed sheets reaches a predetermined value.

19 Claims, 12 Drawing Sheets

IMAGE FORMING APPARATUS WITH OPTICAL SCANNING DEVICE WINDOW CLEANING MEMBER AND CONTROL THEREOF

BACKGROUND OF THE INVENTION

Field of the Invention

The aspect of the embodiments relates to an image forming apparatus that forms an image on a recording medium by using an electrophotographic method, such as an electrophotographic copying machine and a laser beam printer.

Description of the Related Art

Image forming apparatuses using an electrophotographic method conventionally include an optical scanning device that irradiates the surface of a charged photosensitive member with laser light to form an electrostatic latent image. The optical scanning device includes optical system parts such as a light source and a mirror, a casing covering the optical system parts, and an opening for emitting light from the light source to outside the casing. To prevent foreign substances such as toner and dirt from entering the interior of the casing, the opening is closed with a transparent member that transmits the light.

If there are foreign substances such as toner and dirt on the transparent member, the light emitted from the opening can be obstructed, which can lead to a change in optical characteristics and a drop in the quality of the formed image.

Japanese Patent Application Laid-Open No. 2016-31467 discusses a configuration for performing cleaning processing by moving cleaning members over transparent members in contact with the transparent members to remove foreign substances off the transparent members with the cleaning members. Japanese Patent Application Laid-Open No. 2016-31467 discusses a configuration that performs such cleaning processing on a regular basis, for example, each time image formation is performed on 10,000 sheets.

However, depending on the environment in which the image forming apparatus is installed and the use condition of the image forming apparatus, foreign substances such as toner, paper dust, and dirt can fall on the transparent members before the execution of the regular cleaning processing.

In such a case, the foreign objects can be removed off the transparent members by providing a setting to execute cleaning processing based on an instruction accepted from a user via an operation panel before the execution of the regular cleaning processing.

However, if, for example, the cleaning processing is performed based on an instruction from the user immediately before the execution of the regular cleaning processing, the regular cleaning processing is executed immediately after the cleaning processing based on the instruction accepted from the user. In such a case, an image forming operation is to be stopped until the end of the cleaning processing, whereby usability can be impaired.

SUMMARY OF THE INVENTION

The aspect of the embodiments is directed to an image forming apparatus that prevents impairment of the usability while preventing a drop in image quality.

According to an aspect of the embodiments, an image forming apparatus includes an image forming unit including a photosensitive member and an optical scanning device, the optical scanning device including a transparent member configured to pass laser light for scanning the photosensitive member to outside, the image forming unit being configured to form an image on a recording medium by developing an electrostatic latent image formed on the photosensitive member with toner and transferring the electrostatic latent image to the recording medium, the electrostatic latent image being formed by scanning with the laser light, a cleaning mechanism configured to clean the transparent member, a counter configured to retain a number of recording media on which an image is formed by the image forming unit as a count value, an operation unit configured to accept an instruction from an operator, and a control unit configured to execute a cleaning sequence that operates the cleaning mechanism, the control unit being configured to execute the cleaning sequence based on an execution instruction accepted from the operator via the operation unit or when the count value reaches a predetermined value, and if the cleaning sequence is executed, reset the count value retained by the counter.

Further features of the disclosure will become apparent from the following description of exemplary embodiments with reference to the attached drawings.

DESCRIPTION OF THE EMBODIMENTS

Modes for carrying out the aspect of the embodiments will be described below with reference to the drawings. Dimensions, materials, shapes, and relative arrangements of components described below are not intended to limit the scope of the aspect of the embodiments thereto unless otherwise specified.

Figure 1:
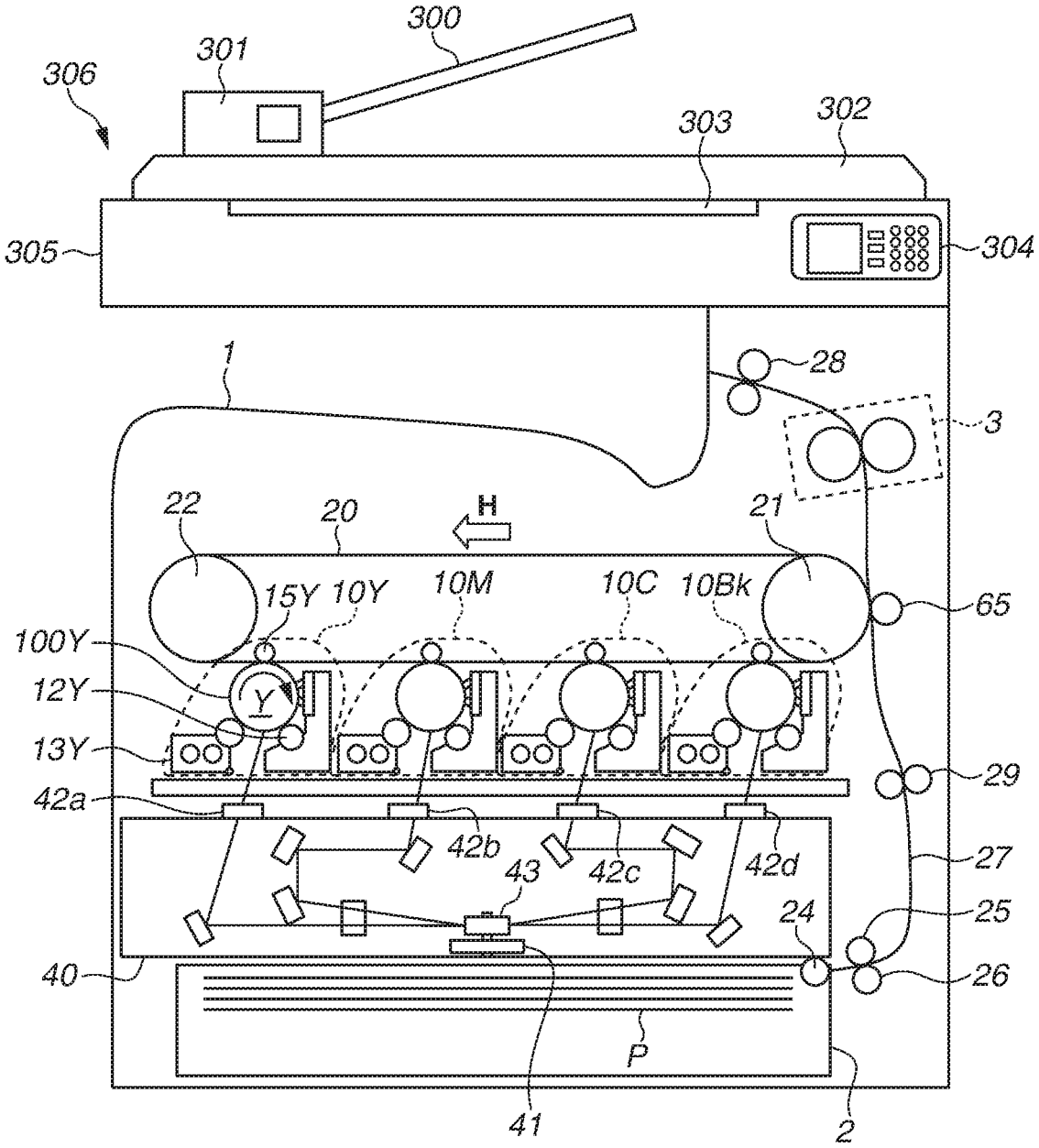
FIG. 1 is a schematic sectional view of an image forming apparatus.

A first exemplary embodiment will be described below. FIG. 1 is a schematic sectional view of an image forming apparatus 1 according to the present exemplary embodiment. As illustrated in FIG. 1, the image forming apparatus 1 according to the present exemplary embodiment is a tandem color laser beam printer including four image forming sections 10Y, 10M, 10C, and 10Bk for forming toner images of yellow (Y), magenta (M), cyan (C), and black (Bk), respectively.

The image forming apparatus 1 according to the present exemplary embodiment includes a reader unit 306 on top of its apparatus main body. The reader unit 306 includes a document conveyance device 301 that automatically conveys a document, a document reading device 305 that reads an image of the conveyed document, and a document discharge tray 302 to which the document is discharged.

The document conveyance device 301 includes a document feed tray 300 on which documents are set. The document conveyance device 301 conveys the documents placed on the document feed tray 300 to a document reading position on a glass plate 303 one by one. The document conveyed onto the glass plate 303 is read by a not-illustrated scanner, such as a charge-coupled device (CCD) scanner and a contact image sensor (CIS) scanner, arranged inside the document reading device 305. The document conveyance device 301 then conveys the document further and discharges the document onto the document discharge tray 302.

The document conveyance device 301 can be opened and closed with respect to the document reading device 305. An operator can open the document conveyance device 301 and place a document on the glass plate 303.

The scanner irradiates the document conveyed onto the glass plate 303 by the document conveyance device 301 or the document placed on the glass plate 303 with light from a light source, and converts light reflected from the document and received by a light reception sensor into an electrical signal. Red (r), green (g), and blue (b) components of the converted electrical signal are output to a control unit such as an engine control unit 74 to be described below.

As illustrated in FIG. 1, the image forming apparatus 1 according to the present exemplary embodiment includes an operation unit 304. The operation unit 304 includes a display that displays setting information about print conditions to an operator such as a user and a serviceperson.

The display can display software keys that the operator operates by a finger touch. The operator can thereby input instruction information about one-sided printing and two-sided printing from an operation panel.

An operation unit 304 includes a start key to be pressed to start an image forming operation and a stop key to be pressed to stop the image forming operation. A numerical keypad includes keys to be pressed to make settings, such as a cleaning setting value to be described below. While the start key, stop key, and numerical keypad of the image forming apparatus 1 according to the present exemplary embodiment are hardware keys provided on the operation unit 304, such keys may be displayed on the display as software keys. Various types of data input from the operation unit 304 are stored in a random access memory (RAM) 501 via the engine control unit 74.

The image forming apparatus 1 includes an intermediate transfer belt 20 to which toner images formed by the image forming sections 10Y, 10M, 10C, and 10Bk are transferred. The toner images stacked on the intermediate transfer belt 20 by the respective image forming sections 10 are then transferred to a sheet P (a recording medium), whereby a color image is formed on the sheet P (on the recording medium). The image forming sections 10Y, 10M, 10C, and 10Bk have substantially the same configuration except that toners of respective different colors are used. The image forming sections 10 will hereinafter be described by using the image forming section 10Y as an example, and a redundant description about the image forming sections 10M, 10C, and 10Bk will be omitted. In the present exemplary embodiment, a recording medium not only refers to a sheet of paper typically used in printing, but also covers sheet-like recording media such as a sheet of cloth, plastic, and film.

An image forming section 10 includes a photosensitive member 100, a charging roller 12, a developing device 13, and a primary transfer roller 15. The charging roller 12 charges the photosensitive member 100 with a uniform background potential. The developing device 13 serves as a developing unit that develops an electrostatic latent image formed on the photosensitive member 100 by an optical scanning device 40 to be described below to form a toner image. The primary transfer roller 15 transfers the formed toner image to the intermediate transfer belt 20. The primary transfer roller 15 forms a primary transfer portion with the photosensitive member 100 via the intermediate transfer belt 20. The primary transfer roller 15 transfers the toner image formed on the photosensitive member 100 to the intermediate transfer belt 20 when a predetermined transfer voltage is applied thereto.

The intermediate transfer belt 20 is formed in an endless shape, and stretched between a first belt conveyance roller 21 and a second belt conveyance roller 22. The toner images formed on the respective image forming sections 10 are transferred to the intermediate transfer belt 20 as the intermediate transfer belt 20 is operated to rotate in the direction of the arrow H. The four image forming sections 10Y, 10M, 10C, and 10Bk are arranged in parallel below the intermediate transfer belt 20 in the vertical direction thereof, and transfer the toner images formed based on image information of the respective colors to the intermediate transfer belt 20. The image forming sections 10 perform the image forming processes of the respective colors in timing such that each toner image is superposed on an upstream toner image or images primarily transferred onto the intermediate transfer belt 20. As a result, a four-color toner image is formed on the intermediate transfer belt 20 in a superposed manner.

The first belt conveyance roller 21 and a secondary transfer roller 65 are pressed against each other with the intermediate transfer belt 20 therebetween. A secondary transfer portion for transferring the toner image to the sheet P is formed between the first belt conveyance roller 21 and the secondary transfer roller 65 via the intermediate transfer belt 20. When the sheet P is passed through the secondary transfer portion, the toner image is transferred from the intermediate transfer belt 20 to the sheet P. Transfer residual toner remaining on the surface of the intermediate transfer belt 20 is collected by a not-illustrated cleaning device.

The image forming sections 10 of the respective colors are arranged in the rotation direction of the intermediate transfer belt 20 (direction of the arrow H) in the following order from the upstream side of the secondary transfer portion: the image forming section 10Y for forming a yellow toner image, the image forming section 10M for forming a magenta toner image, the image forming section 10C for forming a cyan toner image, and the image forming section 10Bk for forming a black toner image.

The optical scanning device 40 serving as an optical scanning unit is located below the image forming sections 10 in the vertical direction thereof. The optical scanning device 40 scans the photosensitive members 100 with laser light to form electrostatic latent images on the respective photosensitive members 100 based on the image information about the image to be formed. The image forming sections 10 and the optical scanning device 40 constitute an example of an image forming unit.

The optical scanning device 40 includes four not-illustrated semiconductor lasers that emit laser beams modulated based on the image information of the respective colors. The optical scanning device 40 also includes a motor unit 41 and a rotating polygonal mirror 43. When rotated by the motor unit 41 at high speed, the rotating polygonal mirror 43 deflects the laser beams emitted from the semiconductor lasers to scan along the direction of the rotation axes of the respective photosensitive members 100. The laser beams deflected by the rotating polygonal mirror 43 are guided by optical members arranged inside the optical scanning device 40, and emitted from inside to outside the optical scanning device 40 via transparent members 42*a* to 42*d* covering respective openings formed in the top part of the optical scanning device 40. The laser beams emitted out of the optical scanning device 40 expose the respective photosensitive members 100.

Sheets P are stored in a feed cassette 2 arranged in a lower part of the image forming apparatus 1. A pickup roller 24 feeds a sheet P to a separation nip portion formed by a feed roller 25 and a retard roller 26. The retard roller 26 is driven to rotate reversely if a plurality of sheets P is fed by the pickup roller 24, whereby the sheets P are conveyed downstream one by one to avoid multiple feeding of sheets P. Each single sheet P conveyed by the feed roller 25 and the retard roller 26 is conveyed to a conveyance path 27 extending substantially vertically along a right side surface of the image forming apparatus 1.

The sheet P is conveyed through the conveyance path 27 from the lower portion to the upper portion of the image forming apparatus 1 in the perpendicular direction of the image forming apparatus 1 and conveyed to a registration roller 29. The registration roller 29 once stops the conveyed sheet P to correct sheet skew. The registration roller 29 then conveys the sheet P to the secondary transfer portion in synchronization with the timing when the toner image formed on the intermediate transfer belt 20 is conveyed to the secondary transfer portion. The sheet P to which the toner image is transferred in the secondary transfer portion is then conveyed to a fixing device 3. The fixing device 3 fixes the toner image to the sheet P by the application of heat and pressure. The sheet P to which the toner image is fixed is then discharged by a discharge roller 28 to a discharge tray provided outside the image forming apparatus 1, on top of the main body of the image forming apparatus 1.

If the image forming sections 10 are located above the optical scanning device 40 in the main body of the image forming apparatus 1, foreign substances such as toner, paper dust, and dirt can fall onto the transparent members 42*a* to 42*d* provided on top of the optical scanning device 40 during image forming operations. In such a case, the laser beams emitted toward the photosensitive members 100 via the transparent members 42*a* to 42*d* are obstructed by the foreign substances. The foreign substances can cause a change in the optical characteristics and thus a drop in image quality.

Figure 2:
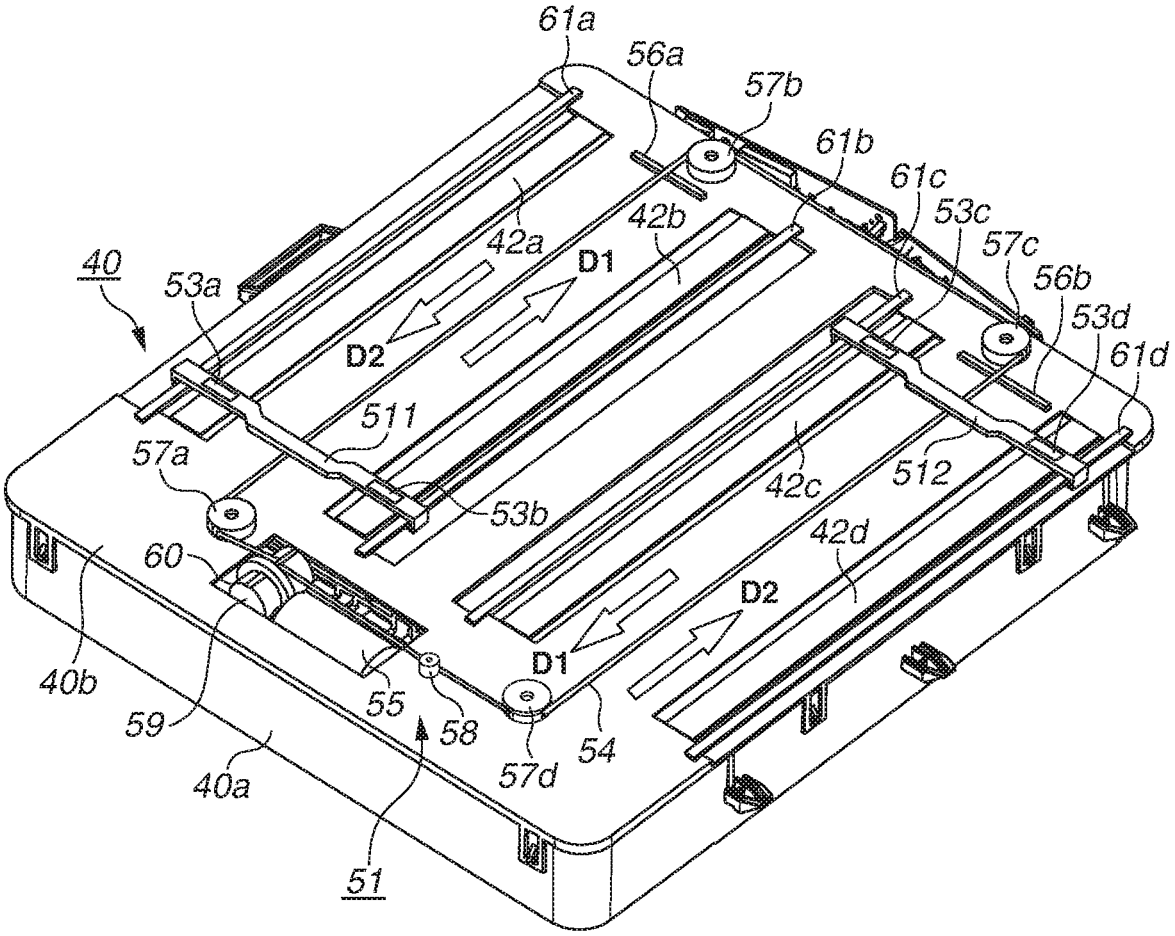
FIG. 2 is a perspective view of an optical scanning device.
Figure 3:
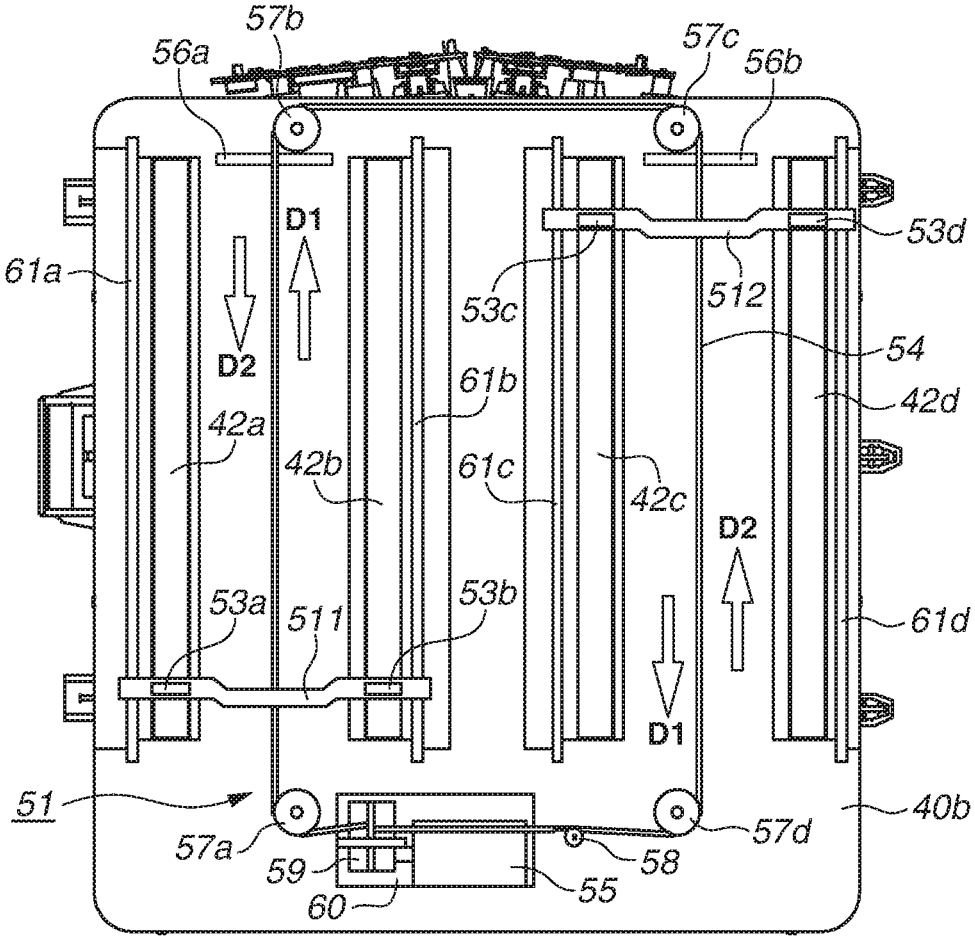
FIG. 3 is a top view of the optical scanning device.

In the present exemplary embodiment, the optical scanning device 40 includes a cleaning mechanism 51 for cleaning the transparent members 42*a* to 42*d*. The optical scanning device 40 and the cleaning mechanism 51 included in the optical scanning device 40 are described in detail below. FIG. 2 is a perspective view illustrating the entire optical scanning device 40. FIG. 3 is a top view of the optical scanning device 40.

As illustrated in FIGS. 2 and 3, the optical scanning device 40 includes an accommodation portion 40*a* and a cover portion 40*b*. The accommodation portion 40*a* accommodates the foregoing motor unit 41 and rotating polygonal mirror 43 inside. The cover portion 40*b* is attached to the accommodation portion 40*a* and covers the top side of the accommodation portion 40*a*. The accommodation portion 40*a* and the cover portion 40*b* constitute the casing of the optical scanning device 40. The cover portion 40*b* has four openings for the laser beams to pass through, which correspond to the photosensitive members 100 of the respective colors. The openings each have a rectangular shape elongated in the direction of the rotation axes of the respective corresponding photosensitive members 100, and are formed to extend longitudinally in parallel with each other. The openings are closed by the respective transparent members 42*a* to 42*d* each formed in a long rectangular shape. There are four transparent members 42*a* to 42*d* like the openings. The transparent members 42*a* to 42*d* are attached to the cover portion 40*b* to extend longitudinally in parallel with each other. The longitudinal direction of the transparent members 42*a* to 42*d* is substantially the same as the scanning direction of the laser beams emitted from the optical scanning device 40. In the present exemplary embodiment, the longitudinal direction of the transparent members 42*a* to 42*d* is substantially the same as the direction of the rotation axes of the respective photosensitive members 100.

The transparent members 42*a* to 42*d* are provided for the purpose of preventing foreign substances such as toner, dirt, and paper dust from entering the interior of the optical scanning device 40, and prevents a drop in image quality due to adhesion of foreign substances to the semiconductor lasers, the mirrors, and the rotating polygonal mirror 43. The transparent members 42*a* to 42*d* are made of transparent members such as glass members, and can transmit the laser beams emitted from the semiconductor lasers inside the accommodation portion 40*a* to the photosensitive members 100. In the present exemplary embodiment, the size of the transparent members 42*a* to 42*d* is set to be greater than the size of the openings so that the transparent members 42*a* to 42*d* overlap and cover the openings in an overlapping manner. The transparent members 42*a* to 42*d* are fixed to the cover portion 40*b* by adhesively bonding the overlapping portions of the transparent members 42*a* to 42*d* to the cover portion 40*b*.

The optical scanning device 40 is thus covered with the cover portion 40*b* and the transparent members 42*a* to 42*d* so that foreign substances such as toner, paper dust, and dirt will not enter the interior of the optical scanning device 40. The transparent members 42*a* to 42*d* larger than the openings are adhesively bonded and fixed onto the cover portion 40*b*, whereby foreign substances such as toner, paper dust, and dirt falling from above the optical scanning device 40 are prevented from entering the interior of the optical scanning device 40 through gaps between the transparent members 42*a* to 42*d* and the respective openings.

The present exemplary embodiment includes the cleaning mechanism 51 that performs cleaning processing for cleaning the foreign substances falling to the top surface of the optical scanning device 40 (top surfaces of the transparent members 42*a* to 42*d*) from above. The top surfaces of the transparent members 42*a* to 42*d* refer to the surfaces on the outer side of the optical scanning device 40 and from which the laser beams passed through the transparent members 42*a* to 42*d* are emitted.

The cleaning mechanism 51 is attached onto the cover portion 40*b* of the optical scanning device 40, on the side opposed to the image forming sections 10. The cleaning mechanism 51 includes cleaning members 53*a* to 53*d*, a first cleaning holder 511, and a second cleaning holder 512. The cleaning members 53*a* to 53*d* are used to clean the top surfaces of the transparent members 42*a* to 42*d* (the surfaces on the outer side of the optical scanning device 40), respectively. The first and second cleaning holders 511 and 512 hold and move the cleaning members 53*a* to 53*d* over the transparent members 42*a* to 42*d*.

The first and second cleaning holders 511 and 512 lie across two adjoining transparent members 42 each, extend in a direction orthogonal to the extending direction of the transparent members 42, and hold two cleaning members 53 each. The first and second cleaning holders 511 and 512 hold cleaning members 53 equal in number to corresponding to the transparent members 42.

More specifically, the first cleaning holder 511 is arranged across the transparent members 42*a* and 42*b*, and holds the cleaning member 53*a* for cleaning the top surface of the transparent member 42*a* and the cleaning member 53*b* for cleaning the top surface of the transparent member 42*b*. The second cleaning holder 512 is arranged across the transparent members 42*c* and 42*d*, and holds the cleaning member 53*c* for cleaning the top surface of the transparent member 42*c* and the cleaning member 53*d* for cleaning the top surface of the transparent member 42*d*.

The cleaning members 53*a* to 53*d* are made of silicone rubber or unwoven fabric, for example. As the first and second cleaning holders 511 and 512 move, the cleaning member 53*a* to 53*d* move in contact with the top surfaces of the transparent members 42. The cleaning members 53*a* to 53*d* can thereby remove foreign substances off the transparent members 42 to clean the top surfaces of the transparent members 42.

The first cleaning holder 511 is connected in the middle to a wire 54, and configured to hold the cleaning members 53*a* and 53*b* on both end sides with the wire 54 at the center. The second cleaning holder 512 is connected in the middle to the wire 54, and configured to hold the cleaning members 53*c* and 53*d* on both end sides with the wire 54 at the center. The wire 54 is stretched to pass through between the transparent members 42*a* and 42*b* and between the transparent members 42*c* and 42*d*.

The wire 54 is stretched over the cover portion 40*b* in an annular shape by four stretching pulleys 57*a* to 57*d*, a tension adjusting pulley 58, and a take-up drum 59 that are rotatably supported on the cover portion 40*b*. The wire 54 is taken up on the take-up drum 59 a predetermined number of turns for length adjustment during assembly of the optical scanning device 40, and in such a state, stretched between the stretching pulleys 57*a* to 57*d*. The four stretching pulleys 57*a* to 57*d* are arranged so that the wire 54 passes between the transparent members 42*a* and 42*b* and between the transparent members 42*c* and 42*d* as described above.

The tension of the wire 54 is adjusted by the tension adjusting pulley 58 provided between the stretching pulleys 57*a* and 57*d*. The wire 54 is thus stretched between the stretching pulleys 57, the tension adjusting pulley 58, and the take-up drum 59 without a slack. The stretched wire 54 can thus be smoothly run in an annular shape.

In the present exemplary embodiment, the tension adjusting pulley 58 is provided between the stretching pulleys 57*a* and 57*d*. However, the position of the tension adjusting pulley 58 is not limited thereto, and may be located at any position as long as the tension of the wire 54 stretched between the stretching pulleys 57*a* to 57*d* can be adjusted.

As described above, in the present exemplary embodiment, the cleaning members 53*a* and 53*b* are arranged on the first cleaning holder 511, and the cleaning members 53*c* and 53*d* are arranged on the second cleaning holder 512. By contrast, if one cleaning holder holds one cleaning member, as many cleaning holders as the transparent members are to be prepared. This increases the length of the wire to which the cleaning holders are attached. In the present exemplary embodiment, the number of cleaning holders can be reduced and the length of the wire 54 can be reduced, compared to the configuration where one cleaning holder holds one cleaning member. The top surfaces of the transparent members 42*a* to 42*d* can thus be cleaned with a simpler configuration.

The take-up drum 59 can be driven to rotate by a take-up motor 55 that is a driving unit.

The take-up motor 55 is configured to rotate in forward and reverse directions. In the present exemplary embodiment, the forward rotation of the take-up motor 55 is in a clockwise (CW) direction, and the reverse rotation a counterclockwise (CCW) direction.

The wire 54 is configured to be taken up on and released from the take-up drum 59 as the take-up drum 59 is rotated by the rotation of the take-up motor 55 in the CW direction or CCW direction. By thus being taken up on and released from the take-up drum 59, the wire 54 stretched between the stretching pulleys 57 can be run annularly over the cover portion 40*b*.

The first and second cleaning holders 511 and 512 connected to the wire 54 can therefore move in the directions of the arrows D1 and D2 (longitudinal direction of the transparent members 42) as the wire 54 runs. In the present exemplary embodiment, the rotation of the take-up motor 55 in the CCW direction moves the first and second cleaning holders 511 and 512 in the direction of the arrow D1. The rotation of the take-up motor 55 in the CW direction moves the first and second cleaning holders 511 and 512 in the direction of the arrow D2.

Since the wire 54 is stretched in the annular shape, the movement of the wire 54 moves the first and second cleaning holders 511 and 512 linearly in opposite directions along the longitudinal direction of the transparent members 42*a* to 42*d*.

The take-up motor 55 and the take-up drum 59 are located in a recess 60 formed in the top surface of the cover portion 40*b*. This can reduce the size of the optical scanning device 40 in the height direction. The recess 60 does not communicate with the interior of the optical scanning device 40. The recess 60 is provided such that foreign substances will not enter the interior of the optical scanning device 40 through the recess 60, either.

A first stopper 56*a* for regulating the movement of the first cleaning holder 511 in the longitudinal direction of the transparent members 42*a* and 42*b* (the direction of the rotation axes of the photosensitive members 100) is arranged on the cover portion 40*b*. A second stopper 56*b* for regulating the movement of the second cleaning holder 512 in the longitudinal direction of the transparent members 42*c* and 42*d* (the direction of the rotation axes of the photosensitive members 100) is also arranged on the cover portion 40*b*. The first and second stoppers 56*a* and 56*b* are examples of abutting members.

The first and second stoppers 56*a* and 56*b* are each located at one end in the longitudinal direction of the transparent members 42*a* to 42*d*. If the first and second cleaning holders 511 and 512 move in the direction of the arrow D1, the first cleaning holder 511 reaches the ends of the transparent members 42*a* and 42*b* in the direction of the arrow D1 and comes into contact with the first stopper 56*a*.

Since the movement of the first cleaning holder 511 in the direction of the arrow D1 is regulated by the first stopper 56*a*, the load acting on the take-up motor 55 rotating the take-up drum 59 to run the wire 54 increases. The load is detected by using a current detection unit to be described below, whereby the arrival of the first cleaning holder 511 at the first stopper 56*a* is detected. Here, the second cleaning holder 512 is located on the opposite side from the first cleaning holder 511 in the longitudinal direction of the transparent members 42.

Now, a series of cleaning processes made by the movement of the first and second cleaning holders 511 and 512 according to the present exemplary embodiment will be described.

Initially, the take-up motor 55 is driven to rotate in the CW direction. The wire 54 is thereby run in the direction of the arrow D2, and the first and second cleaning holders 511 and 512 accordingly move in the direction of the arrow D2.

The second cleaning holder 512 then reaches the ends of the transparent members 42*c* and 42*d* in the direction of the arrow D2 and comes into contact with the second stopper 56*b*. Since the movement of the second cleaning holder 512 in the direction of the arrow D2 is regulated by the second stopper 56*b*, the load acting on the take-up motor 55 rotating the take-up drum 59 to run the wire 54 increases. The load is detected by using the current detection unit to be described below, whereby the arrival of the second cleaning holder 512 at the second stopper 56*b* is detected.

If the arrival of the second cleaning holder 512 at the second stopper 56*b* is detected, the rotation of the take-up motor 55 is stopped. Here, the first cleaning holder 511 has reached a second position on the other end side in the longitudinal direction of the transparent members 42. Since the rotation of the take-up motor 55 is stopped, the movement of the first cleaning holder 511 is stopped at the second position in the longitudinal direction of the transparent members 42.

The take-up motor 55 is then rotated in the CCW direction to run the wire 54 in the direction of the arrow D1. This moves both the first and second cleaning holders 511 and 512 in the direction of the arrow D1.

The first cleaning holder 511 then reaches the ends of the transparent members 42*a* and 42*b* in the direction of the arrow D1 and comes into contact with the first stopper 56*a*. Since the movement of the first cleaning holder 511 in the direction of the arrow D1 is regulated by the first stopper 56*a*, the load acting on the take-up motor 55 rotating the take-up drum 59 to run the wire 54 increases. The load is detected by using the current detection unit to be described below, whereby the arrival of the first cleaning holder 511 at the first stopper 56*a* is detected.

If the arrival of the first cleaning holder 511 at the first stopper 56*a* is detected, the rotation of the take-up motor 55 in the CCW direction is stopped, and then the take-up motor 55 is rotated in the CW direction by a predetermined amount of rotation. After the wire 54 is thus run by a predetermined distance in the direction of the arrow D2, the rotation of the take-up motor 55 is stopped.

In the present exemplary embodiment, that the first and second cleaning holders 511 and 512 make one reciprocation over the transparent members 42*a* and 42*b* and the transparent members 42*c* and 42*d*, respectively, will be referred to as a series of cleaning processes. After the series of cleaning processes is ended, the wire 54 is run by a predetermined distance in the direction of the arrow D2 so that the first cleaning holder 511 stops operation at a position where the first cleaning holder 511 is not in contact with the first stopper 56*a* and the cleaning members 53 are not in contact with the surfaces of the transparent members 42.

In other words, the first cleaning holder 511 is located in a no-passing area where the laser beams do not pass through the transparent members 42, between the ends of the transparent members 42 in the longitudinal direction of the transparent members 42 and the first stopper 56*a*. Here, the second cleaning holder 512 stops operation at a position where the second cleaning holder 512 is not in contact with the ends of the transparent members 42 in the longitudinal direction, i.e., in a non-passing area where the laser beams do not pass through the transparent members 42. The stop positions of the first and second cleaning holders 511 and 512 at the end of the series of cleaning processes are cleaning stop positions and cleaning start positions.

In the series of cleaning processes described above, if the second cleaning holder 512 reaches the second stopper 56*b*, the rotation of the take-up motor 55 is stopped and then the take-up motor 55 is rotated in the CCW direction. However, the take-up motor 55 may be rotated in the CCW direction upon the arrival at the second stopper 56*b*.

The present exemplary embodiment is configured so that the forward rotation (rotation in the CW direction) of the take-up motor 55 runs the wire 54 in the direction of the arrow D2, and the reverse rotation (rotation in the CCW direction) of the take-up motor 55 runs the wire 54 in the direction of the arrow D1. However, the wire 54 may be run in the direction of the arrow D1 by the forward rotation of the take-up motor 55, and in the direction of the arrow D2 by the reverse rotation of the take-up motor 55.

Figure 4:
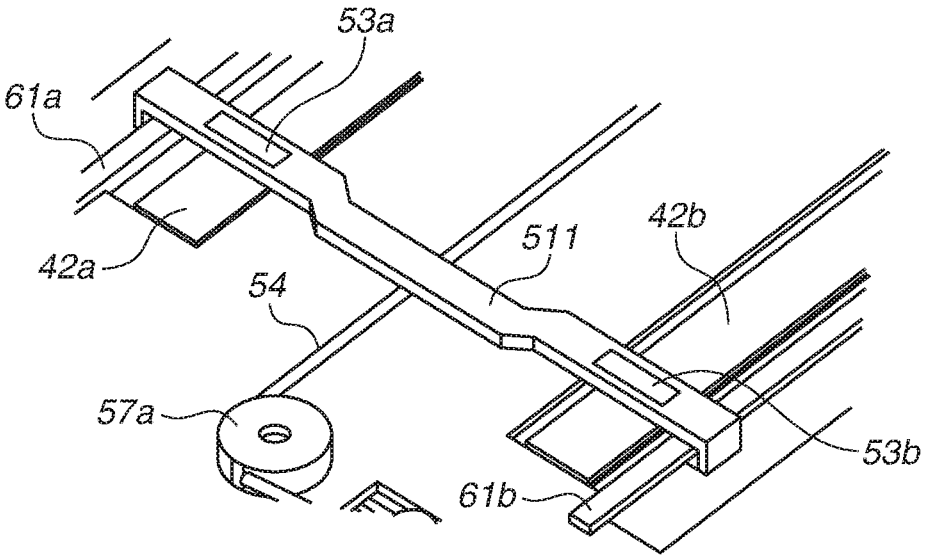
FIG. 4 is a partial perspective view of a first cleaning holder.
Figure 5:
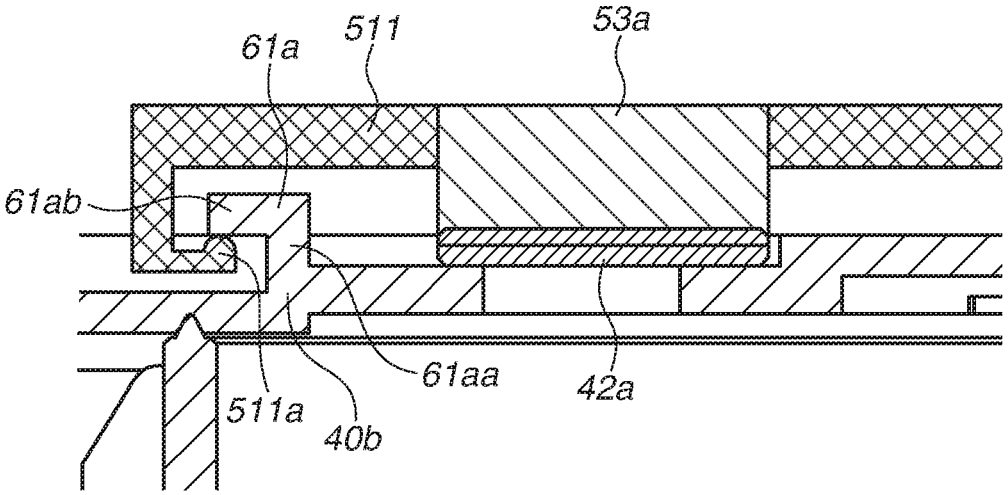
FIG. 5 is a partial sectional view of the first cleaning holder.

The cover portion 40*b* is provided with guide members 61*a* to 61*d* for guiding the movement of the first and second cleaning holders 511 and 512. As illustrated in FIGS. 4 and 5, both ends of the first cleaning holder 511 are engaged with the guide members 61*a* and 61*b*, respectively.

FIG. 4 is a partial perspective view illustrating the vicinity of the first cleaning holder 511. Like the first cleaning holder 511, the second cleaning holder 512 is configured so that both ends of the second cleaning holder 512 are engaged with the guide members 61*c* and 61*d*, respectively. FIG. 5 is a partial sectional view at the end of the first cleaning holder 511 on the side where the cleaning member 53*a* is held. While in the present exemplary embodiment the configuration of only the first cleaning holder 511 is described, a similar configuration is applied to the second cleaning holder 512.

As illustrated in FIGS. 4 and 5, the guide members 61*a* and 61*b* are integrally formed with the cover portion 40*b* and protruded upward from the top surface of the cover portion 40*b*.

As illustrated in FIG. 5, the guide member 61*a* includes a first protrusion 61*aa* protruding upward from the top surface of the cover portion 40*b*, and a second protrusion 61*ab* extending from the first protrusion 61*aa* in a direction away from the cleaning member 53*a*.

An end 511*a* of the first cleaning holder 511 on one end side is formed to get into under the second protrusion 61*ab*. The end 511*a* is configured so that the contact portion with the second protrusion 61*ab* has an arc shape. The arc-shaped end 511*a* can reduce a sliding resistance when the first cleaning holder 511 moves in the directions of the arrows D1 and D2 (see FIG. 3).

In the present exemplary embodiment, only one end side of the first cleaning holder 511 is described in detail. The guide member 61*b* on the other end side has a similar configuration. The second cleaning holder 512 also has a similar shape.

The engagement of the first and second cleaning holders 511 and 512 with the guide members 61*a* to 61*d* prevents the cleaning members 53*a* to 53*d* held by the first and second cleaning holders 511 and 512 from being separated from transparent members 42*a* to 42*d*. The first and second cleaning holders 511 and 512 are engaged with the guide members 61*a* to 61*d* at positions such that the cleaning members 53*a* to 53*d* come into contact with the transparent members 42*a* to 42*d* with a predetermined contact pressure.

In the present exemplary embodiment, the guide members 61*a* to 61*d* and the first and second stoppers 56*a* and 56*b* are integrally formed of resin with the cover portion 40*b*. However, the guide members 61*a* to 61*d* and the first and second stoppers 56*a* and 56*b* may be configured as members separate from the cover portion 40*b*.

As described above, in the present exemplary embodiment, the top surfaces of the transparent members 42*a* to 42*d* can be cleaned by moving the first and second cleaning holders 511 and 512 in the directions of the arrows D1 and D2 during cleaning processing. The cleaning processing is executed at any timing when an instruction to execute the cleaning processing is accepted from the operator via the operation unit 304, and on a regular basis when the cumulative number of image-formed sheets reaches a predetermined number of sheets (predetermined value).

As an initial setting, the predetermined number of sheets (predetermined value) to execute regular cleaning processing is set to 2000 in advance. The operator can change the initial setting of the predetermined number of sheets to execute the cleaning processing, for example, by inputting a value indicating every 500 sheets via the operation unit 304.

If the cleaning processing is thus executed on a regular basis and the number of image-formed sheets reaches the predetermined number of sheets (predetermined value) during execution of an image forming job, the image forming job is suspended to execute cleaning processing as a cleaning sequence for operating the cleaning mechanism 51.

Figure 6:
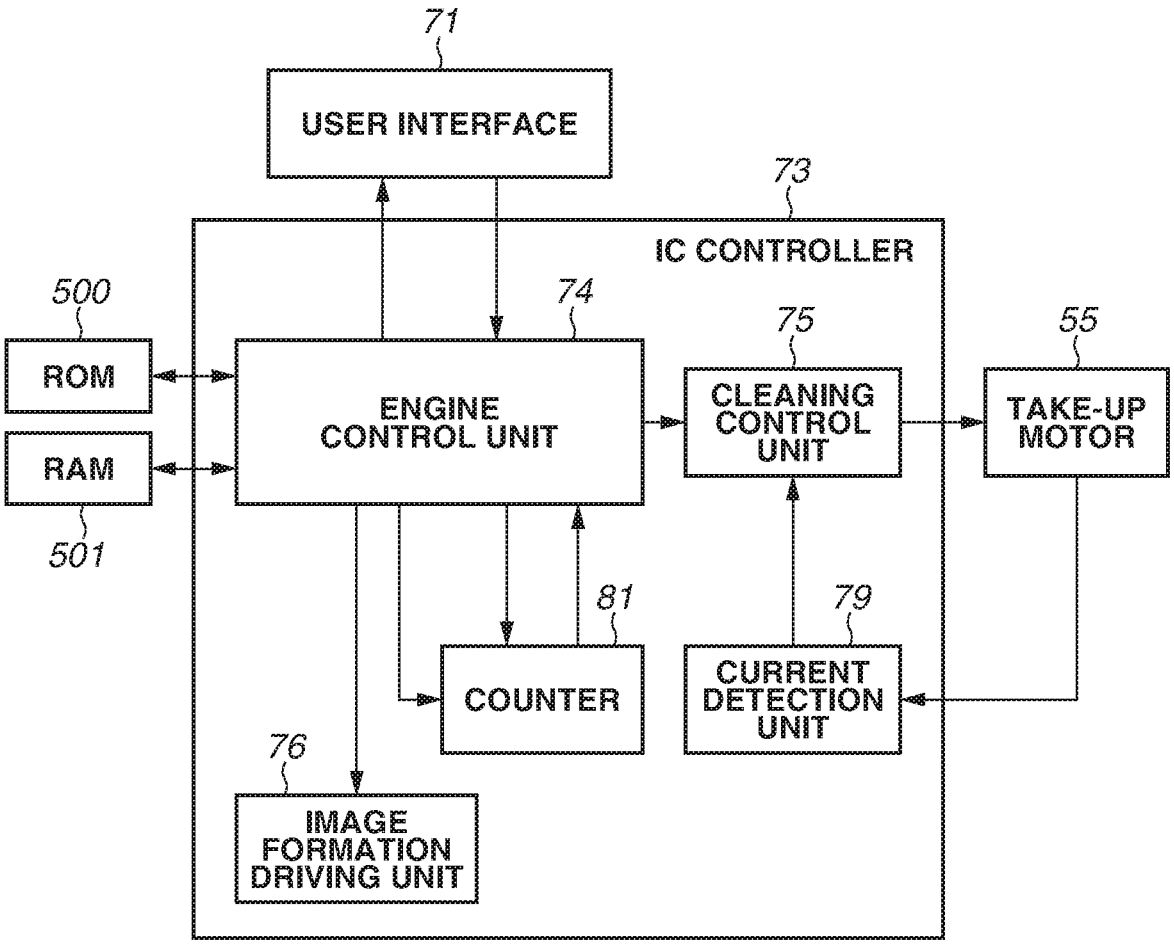
FIG. 6 is a control block diagram illustrating a control configuration for performing cleaning processing.
Figure 7:
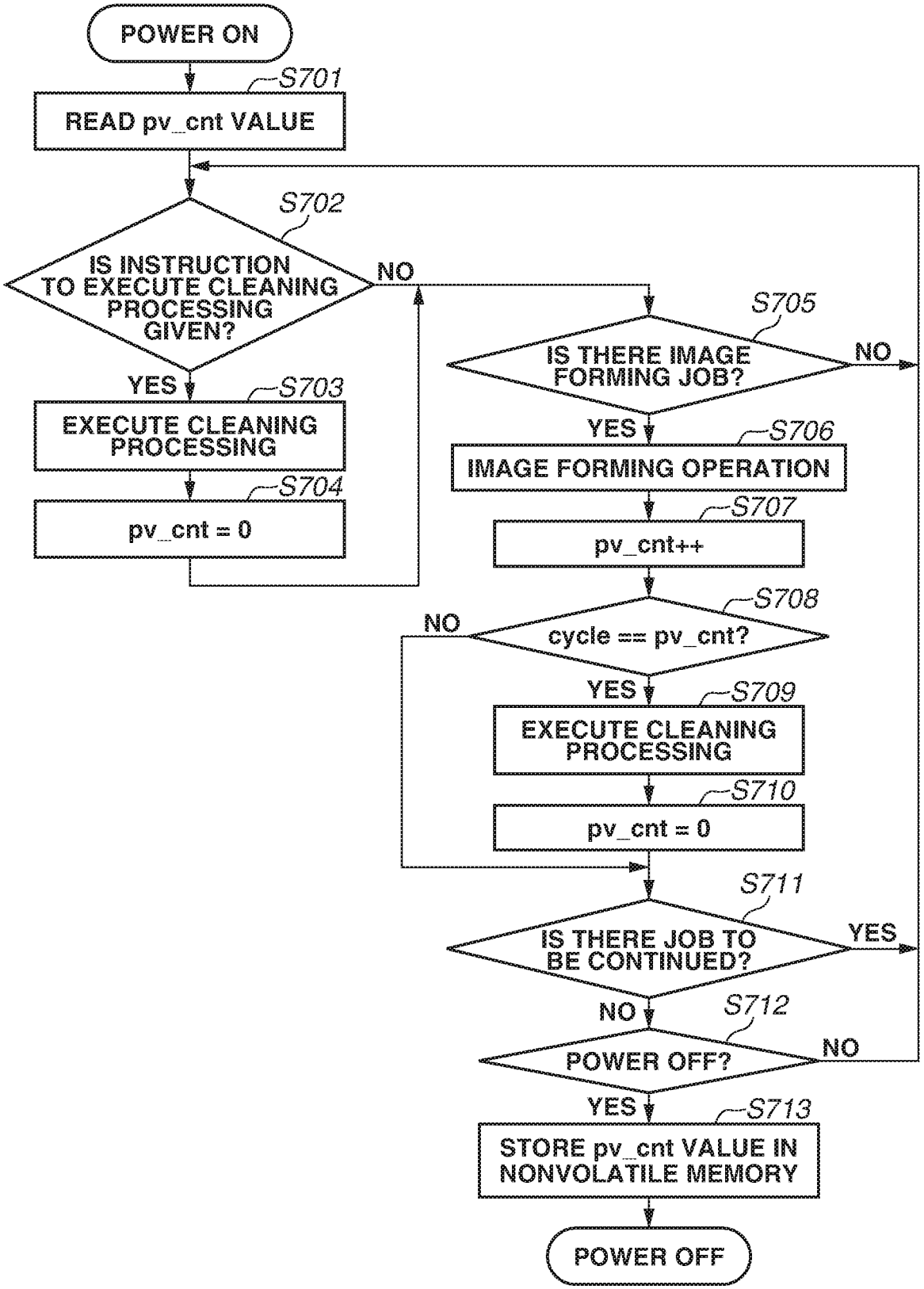
FIG. 7 is a flowchart illustrating a sequence in executing cleaning processing according to a first exemplary embodiment.

The cleaning sequence in executing image forming jobs according to the present exemplary embodiment will be described below with reference to FIGS. 6 to 8. FIG. 6 is a control block diagram illustrating a control configuration for performing the cleaning sequence according to the present exemplary embodiment. FIG. 7 is a flowchart illustrating the cleaning sequence according to the present exemplary embodiment.

As illustrated in FIG. 6, an integrated circuit (IC) controller 73 includes an engine control unit 74, a cleaning control unit 75, a current detection unit 79, an image formation driving unit 76, and a counter 81 as built-in modules. The cleaning control unit 75 is intended to control the take-up motor 55. The current detection unit 79 detects a driving current of the take-up motor 55. The image formation driving unit 76 drives the image forming sections 10 and the intermediate transfer belt 20. The counter 81 counts the cumulative number of image-formed sheets.

The IC controller 73 is configured to control the user interface 71, the take-up motor 55, and the image formation driving unit 76 via the engine control unit 74. Cleaning operation control that the IC controller 73 performs by controlling the modules via the engine control unit 74 will be described below.

The engine control unit 74 initially reads a firmware program and a boot program for controlling the firmware program that are stored in the ROM 500. The IC controller 73 performs various controls via the engine control unit 74 by using the RAM 501 as a work area and a temporary data storage area. The IC controller 73 and the engine control unit 74 are each an example of a control unit that can execute the cleaning sequence based on the operator's instruction or the fact that the cumulative number of image-formed sheets reaches a set number of sheets for cleaning (cleaning setting value) that is a predetermined value.

The engine control unit 74 can obtain setting information about an image forming job from the operator and notify the operator of various types of information via the user interface 71 that is displayed on the operation unit 304 included in the image forming apparatus 1. The operation unit 304 is an example of an operation unit. For example, the operation unit 304 is constituted by stacking a liquid crystal display panel and a resistive or capacitive touch panel.

The user interface 71 can accept operations made by the operator via the touch panel based on display on the display panel. The operator can set the execution timing of image forming operations and the execution timing of cleaning via the user interface 71. The execution timing of regular cleaning processing is determined based on a cleaning setting value that is set by the operator via the user interface 71 and stored in a nonvolatile memory (not illustrated) such as a flash ROM (or an initial value of the cleaning setting value stored in the nonvolatile memory in advance).

The user also gives instructions to execute irregular cleaning processing at freely selected timing via the user interface 71.

For that purpose, the engine control unit 74 displays the user interface 71 that enables the operator to make selections on the operation unit 304. The operator makes an input based on the display, whereby setting information from the operator is obtained. FIG. 8 illustrates an example of the user interface 71 for accepting the operator's instructions at any timing according to the present exemplary embodiment.

Figure 8:
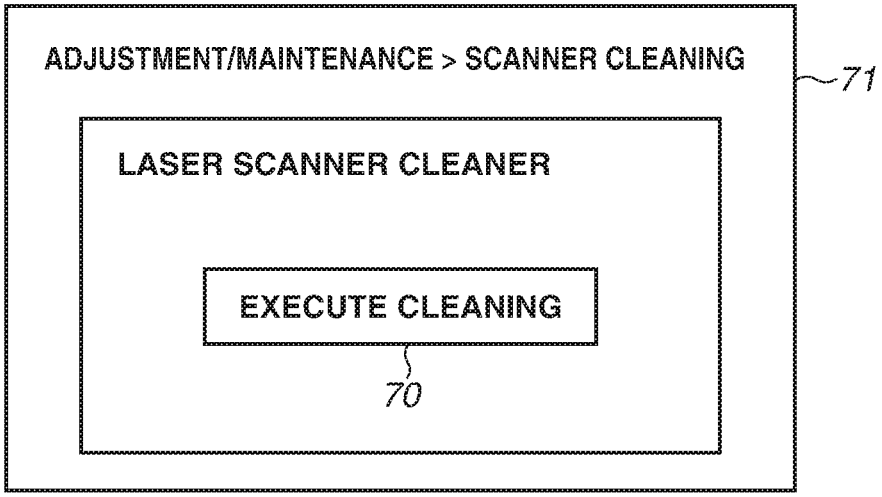
FIG. 8 is an explanatory diagram illustrating a display example of a user interface.

As illustrated in FIG. 8, if a setting mode is selected, the engine control unit 74 displays a cleaning execution key 70 for the operator to start the cleaning processing on the user interface 71. The operator can start the cleaning processing at freely selected timing by a touch operation on the cleaning execution key 70 based on the display.

More specifically, if the cleaning execution key 70 is operated by the operator, the engine control unit 74 controls the cleaning control unit 75 to execute the cleaning processing. If the cleaning execution key 70 is operated during execution of an image forming job, the engine control unit 74 may display a message for confirming whether to suspend the image forming job to execute the cleaning processing on the user interface 71.

The cleaning processing to be executed by the operation of the cleaning execution key 70 refers to the cleaning processing that is irregularly executed based on the instruction from the operator regardless of the timing when the cleaning processing is executed on a regular basis, for example, each time image formation is performed on 10,000 sheets or so. The irregularly executed cleaning processing and the regularly executed cleaning processing include the same cleaning operation of the cleaning mechanism 51. Specifically, the cleaning operation, whether irregular or regular, includes one reciprocating movement of the first and second cleaning holders 511 and 512 over the transparent members 42*a* to 42*d*. The cleaning operation in the irregular cleaning processing and the cleaning operation in the regular cleaning processing do not necessarily need to be the same. The number of reciprocations in the irregularly executed cleaning processing may be greater than that in the regularly executed cleaning processing.

The engine control unit 74 stores (accumulates) an image forming job accepted from the operator via the user interface 71 into the RAM 501. The engine control unit 74 executes the image forming job stored in the RAM 501 by controlling the image formation driving unit 76 based on the image forming job in response to a job execution permission given by the user.

The engine control unit 74 also stores an image forming job accepted via a not-illustrated network line into the RAM 501. The engine control unit 74 executes the image forming job stored in the RAM 501 by controlling the image formation driving unit 76 based on the image forming job.

If the engine control unit 74 accepts a plurality of image forming jobs via the operation unit 304 and/or the not-illustrated network line, the engine control unit 74 stores the image forming jobs in the RAM 501 in the order of acceptance. The engine control unit 74 controls the image formation driving unit 76 to successively execute the plurality of image forming jobs based on the order of storage.

In performing an image forming operation on a recording medium, the engine control unit 74 outputs an image formation instruction to the image formation driving unit 76 and a count signal to the counter 81. The counter 81 counts up based on the count signal. The counter 81 counts by one when a sheet passes through the secondary transfer portion or when an image is formed on the recording medium. Aside from such counting methods, the counter 81 may count by one when an image of which a video count value counted by a not-illustrated video count unit is greater than or equal to a predetermined value is formed.

The engine control unit 74 stores the count value counted by the counter 81 into the nonvolatile memory as the cumulative number of sheets (recording media) on which an image is formed. The engine control unit 74 compares the count value counted by the counter 81 with the cleaning setting value for regular cleaning stored in the nonvolatile memory. If the count value is greater than or equal to the cleaning setting value stored in the nonvolatile memory, the engine control unit 74 outputs a cleaning execution instruction to the cleaning control unit 75. If the cleaning processing is executed, the engine control unit 74 resets the count value of the counter 81 to 0.

In the present exemplary embodiment, the count value of the counter 81 is also reset if the irregular cleaning processing is executed regardless of the count value (cumulative number of image-formed sheets). For example, if the set number of sheets for the regular cleaning processing is 2,000, the cleaning processing is automatically executed at a count value of 2,000 or more, and the count value of the counter 81 is reset. If the operator executes the irregular cleaning processing after the execution of image formation on a recording medium, the count value of the counter 81 is reset at this timing.

Suppose that the set number of sheets for the regular cleaning processing is 2,000, the count value of the counter 81 is 1,980, and the operator executes the irregular cleaning processing. In such a case, the count value of the counter 81 is reset at this timing. In resetting the count value after the execution of the cleaning processing, the count value may be reset to a value smaller than the count value during the execution of cleaning, and may be reset to a value other than 0 (e.g., 1, 10).

By thus resetting the count value even in the case where the cleaning operation is irregularly executed based on an instruction given from the user at freely selected timing, the engine control unit 74 can prevent the regular cleaning operation from being executed immediately after the execution of the irregular cleaning operation. This can prevent a drop in usability due to successive cleaning operations in a short period.

The engine control unit 74 drives the take-up motor 55 to rotate by outputting a motor control signal to the take-up motor 55 via the cleaning control unit 75. The IC controller 73 can thus operate the take-up motor 55 via the cleaning control unit 75. During a cleaning operation, the IC controller 73 detects a driving current from the take-up motor 55 via the current detection unit 79.

The take-up motor 55 is controlled by a constant voltage. If the first cleaning holder 511 or the second cleaning holder 512 comes into contact with the first stopper 56*a* or the second stopper 56*b*, the driving current increases with the increasing load acting on the take-up motor 55.

If the driving current detected by the current detection unit 79 exceeds a predetermined value, the IC controller 73 detects that the first cleaning holder 511 or the second cleaning holder 512 is in contact with the first stopper 56*a* or the second stopper 56*b* and a movement in one direction from one end to the other end of the transparent members 42 is ended. In other words, the IC controller 73 detects that cleaning in one direction in a reciprocal operation is finished.

If the driving current is detected exceeding the predetermined value, the engine control unit 74 thus outputs a movement completion signal to the cleaning control unit 75. Upon receiving the movement completion signal, the cleaning control unit 75 stops driving the take-up motor 55 to rotate.

The predetermined value is a value greater than that of the driving current flowing through the take-up motor 55 when the first and second cleaning holders 511 and 512 are moving over the transparent members 42. In other words, the predetermined value is a value greater than that of the driving current flowing through the take-up motor 55 before the first cleaning holder 511 or the second cleaning holder 512 comes into contact with the first stopper 56*a* or the second stopper 56*b*.

The predetermined value is set to a value such that the contact of the first cleaning holder 511 or the second cleaning holder 512 with the first stopper 56*a* or the second stopper 56*b* can be detected and that does not include the value of current that can increase due to other variations such as a motor failure.

It may be determined whether the first and second cleaning holders 511 and 512 have moved from one longitudinal end to the other of the transparent members 42 by determining the amount of change in the detected current value instead of comparison with the predetermined value.

If the cleaning operation is determined to be completed, the engine control unit 74 stops the take-up motor 55 via the cleaning control unit 75, and outputs a cleaning completion notification to the user interface 71. Based on the cleaning completion notification, the user interface 71 notifies the operator of the completion of the cleaning operation by displaying a screen indicating that the cleaning operation has been completed on the not-illustrated display unit. The notification of the completion of the cleaning operation to the operator may be made by producing a sound instead of displaying the screen on the display unit. If the notification is bothersome, the notification itself may be omitted.

On the other hand, if the cleaning operation is determined to be not completed, the IC controller 73 continues the cleaning operation by outputting a cleaning execution instruction to the cleaning control unit 75 again and controlling the take-up motor 55 via the cleaning control unit 75. The cleaning control unit 75 can control the first and second cleaning holders 511 and 512 to perform a reciprocal operation by rotating the take-up motor 55 forward and reversely.

In the present exemplary embodiment, the engine control unit 74, the cleaning control unit 75, the current detection unit 79, and the counter 81 are built in the IC controller 73. However, such a configuration is not restrictive. For example, modules different from those built-in modules of the IC controller 73 described in the present exemplary embodiment may be used to perform the controls of the IC controller 73 during the cleaning operation. Various controls may be performed by a controller including a built-in ROM 500 and RAM 501.

The image formation driving unit 76 outputs the image formation signal to the counter 81 once when image formation is performed on one side of a sheet, and twice in total when image formation is performed on both sides of a sheet. The counter 81 increases the count value by one each time the image formation signal is received.

Next, control performed by the engine control unit 74 of the IC controller 73 during execution of the cleaning sequence according to the present exemplary embodiment will be described with reference to the flowchart of FIG. 7.

In step S701, the engine control unit 74 initially reads the count value (referred to as a pv_cnt value) from the nonvolatile memory and loads the pv_cnt value into the counter 81.

In step S702, the engine control unit 74 determines whether an instruction to execute the cleaning processing is given by the operator via the user interface 71. If an instruction to execute the cleaning processing is given by the operator (YES in step S702), the processing proceeds to step S703. In step S703, the engine control unit 74 executes the cleaning processing. In step S704, the engine control unit 74 resets the count value of the counter 81 to 0. The processing proceeds to step S705 (processing for determining whether there is an image forming job). If there is no instruction to execute the irregular cleaning job (NO in step S702), the processing proceeds to step S705 (processing for determining whether there is an image forming job).

In step S705, the engine control unit 74 determines whether there is an image forming job in the RAM 501. If there is an image forming job (YES in step S705), the processing proceeds to step S706. In step S706, the engine control unit 74 controls the image formation driving unit 76 to execute an image forming operation. In step S707, the engine control unit 74 causes the counter 81 to perform a count-up operation (operation for incrementing the count value) by outputting the count signal to the counter 81. The counter 81 increments the count value by one based on the count signal from the engine control unit 74.

In step S708, the engine control unit 74 compares the cleaning setting value (denoted as Cycle) stored in the nonvolatile memory in advance with the count value of the counter 81. If the cleaning setting value and the count value coincide (YES in step S708), the processing proceeds to step S709. In step S709, the engine control unit 74 executes the cleaning processing. In step S709, if the image forming job started to be executed in step S706 is still in process, the engine control unit 74 suspends the image forming job and executes the cleaning processing. In step S710, the engine control unit 74 resets the count value of the counter 81 to 0. On the other hand, if the cleaning setting value and the count value do not coincide (NO in step S708), the processing proceeds to step S711.

In step S711, the engine control unit 74 determines whether there is a job to be continued. The job to be continued refers to either a continuation of the image forming job executed in step S706 (image forming job to be executed after the suspension by the cleaning operation) or the next image forming job stored in the RAM 501 after the one executed in step S706.

If there is a job to be continued (YES in step S711), the processing returns to step S702 and the engine control unit 74 continues the foregoing procedure. On the other hand, if there is no job to be continued (NO in step S711), the processing proceeds to step S712. In step S712, the engine control unit 74 determines whether to power off the image forming apparatus 1.

If the engine control unit 74 determines not to power off the image forming apparatus 1 (NO in step S712), the processing returns to step S702 and the engine control unit 74 continues the foregoing procedure. On the other hand, if the engine control unit 74 determines to power off the image forming apparatus 1 (YES in step S712), the processing proceeds to step S713. In step S713, the engine control unit 74 stores the current count value counted by the counter 81 into the nonvolatile memory. The cleaning operations based on the flowchart of FIG. 7 are ended.

As described above, in the present exemplary embodiment, the cumulative number of image-formed sheets (count value) counted for regular cleaning is reset even if a cleaning operation is performed based on an instruction given from the user at freely selected timing regardless of the number of image-formed sheets.

The regular cleaning operation (cleaning processing executed when the cumulative number of image-formed sheets reaches a predetermined number of sheets) can thereby be prevented from being executed immediately after the irregular cleaning operation (cleaning processing executed by an instruction given at freely selected timing regardless of the number of image-formed sheets). This can prevent a drop in usability due to successive cleaning operations in a short period. This can also prevent a drop in productivity due to suspension of an image forming job a plurality of times by execution of a plurality of cleaning operations in a short period.

Next, a second exemplary embodiment will be described. The second exemplary embodiment includes a similar configuration to that of the first exemplary embodiment except that the method for resetting the counter 81 in executing a cleaning operation. Similar components are designated by the same reference numerals, and a description thereof will be omitted.

Figure 9:
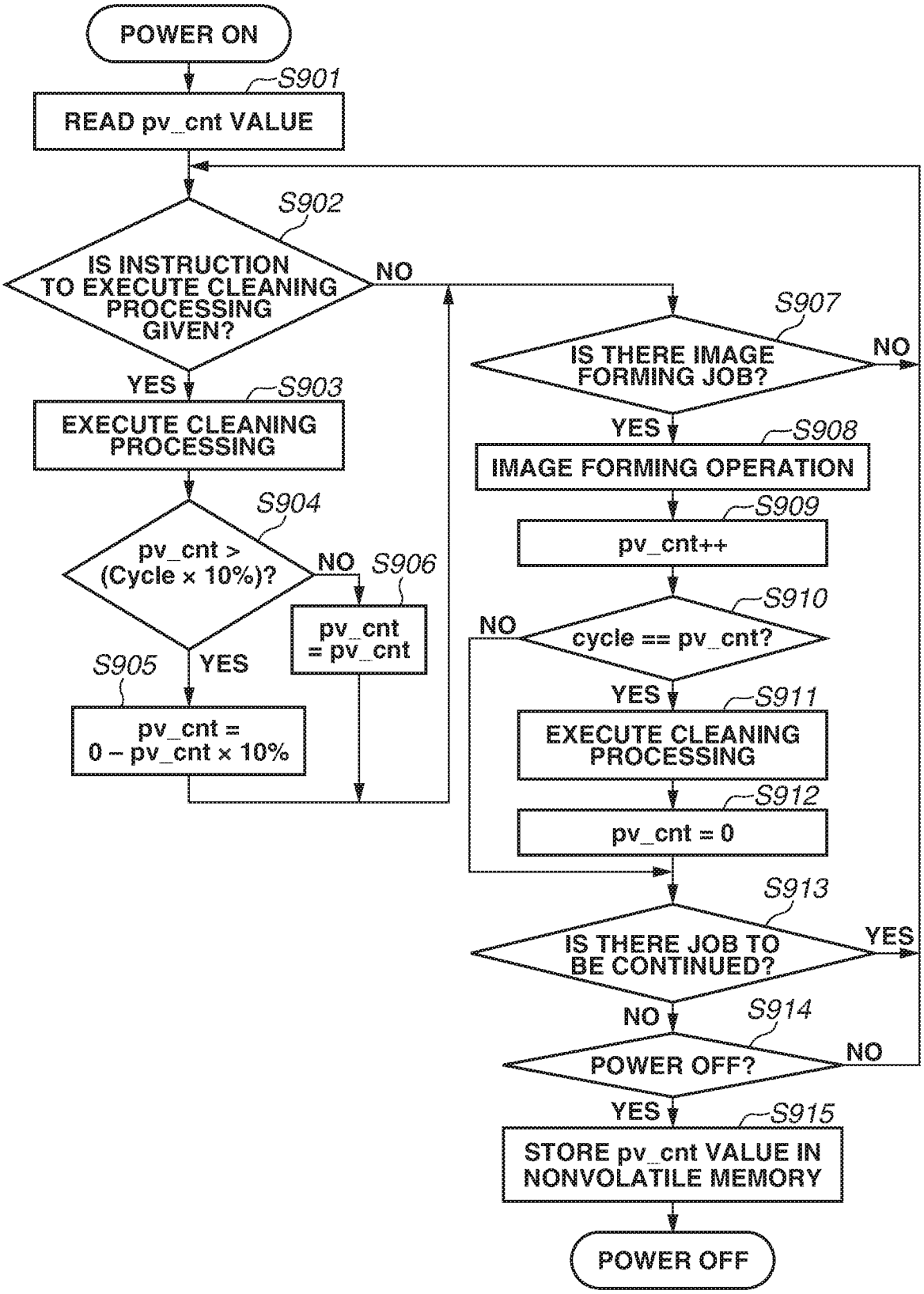
FIG. 9 is a flowchart illustrating a sequence in executing cleaning processing according to a second exemplary embodiment.

In the second exemplary embodiment, when the cleaning sequence is irregularly executed, the count value of the counter 81 is not reset to 0. Instead, the count value of the counter 81 before the execution of the cleaning sequence is reduced and reset to a value less than or equal to 10% of the cleaning setting value. Such a control method is described below with reference to FIG. 9. FIG. 9 is a flowchart illustrating the cleaning sequence according to the second exemplary embodiment.

In step S901, the engine control unit 74 initially reads the count value (referred to as pv_cnt value) from the nonvolatile memory and loads the pv_cnt value into the counter 81.

In step S902, the engine control unit 74 determines whether an instruction to execute the cleaning processing is given from the operator via the user interface 71. If an instruction to execute the cleaning processing is given by the operator (YES in step S902), the processing proceeds to step S903. In step S903, the engine control unit 74 executes the cleaning processing. In step S904, the engine control unit 74 determines whether the count value of the counter 81 is greater than 10% of the cleaning setting value (denoted as Cycle) stored in the nonvolatile memory in advance.

If the count value is greater than 10% of the cleaning setting value (YES in step S904), the processing proceeds to step S905. In step S905, the engine control unit 74 resets the counter 81 to a value less than 10% of the count value. The processing proceeds to step S907. On the other hand, if the count value is less than or equal to 10% of the cleansing setting value (NO in step S904), the processing proceeds to step S906. In step S906, the engine control unit 74 maintains the count value before the execution of the cleaning processing in step S903. The processing proceeds to step S907.

In the present exemplary embodiment, it is determined whether the count value is greater than 10% of the cleaning setting value in step S904. However, the count value may be compared with any numerical value less than or equal to 50% of the cleaning setting value. Similarly, in step S905, the count value is set to a value less than or equal to 10% of the count value. However, such a configuration is not restrictive. The value may be modified based on the ratio to the cleaning setting value compared in step S904.

In step S907, the engine control unit 74 determines whether there is an image forming job in the RAM 501. If there is an image forming job (YES in step S907), the processing proceeds to step S908. In step S908, the engine control unit 74 controls the image formation driving unit 76 to execute an image forming operation. In step S909, the engine control unit 74 causes the counter 81 to perform a count-up operation (operation for incrementing the count value) by outputting the count signal to the counter 81. The counter 81 increments the count value by one based on the count signal from the engine control unit 74.

In step S910, the engine control unit 74 compares the cleaning setting value stored in the nonvolatile memory in advance with the count value of the counter 81. If the cleaning setting value and the count value coincide (YES in step S910), the processing proceeds to step S911. In step S911, the engine control unit 74 executes the cleaning processing. In step S911, if the image forming job started to be executed in step S908 is still in process, the engine control unit 74 suspends the image forming job and executes the cleaning processing. In step S912, the engine control unit 74 resets the count value of the counter 81 to 0. On the other hand, if the cleaning setting value and the count value do not coincide (NO in step S910), the processing proceeds to step S913. In step S913, the engine control unit 74 determines whether there is a job to be continued.

The job to be continued refers to a continuation of the image forming job executed in step S908 (image forming job to be executed after the suspension by the cleaning operation) or the next image forming job stored in the RAM 501 after the one executed in step S908.

If there is a job to be continued (YES in step S913), the processing proceeds to step S902 and the engine control unit 74 continues the foregoing procedure. On the other hand, if there is no job to be continued (NO in step S913), the processing proceeds to step S914. In step S914, the engine control unit 74 determines whether to power off the image forming apparatus 1.

If the engine control unit 74 determines to not power off the image forming apparatus 1 (NO in step S914), the processing returns to step S902 and the engine control unit 74 continues the foregoing procedure. On the other hand, if the engine control unit 74 determines to power off the image forming apparatus 1 (YES in step S914), the processing proceeds to step S915. In step S915, the engine control unit 74 stores the current count value counted by the counter 81 into the nonvolatile memory. The cleaning sequence based on the flowchart of FIG. 9 is ended.

As described above, in the present exemplary embodiment, if the cleaning sequence is executed based on an instruction given from the user at freely selected timing regardless of the number of image-formed sheets and the cumulative number of image-formed sheets counted (count value) is greater than 10% of the set number of sheets for cleaning, the cumulative number of image-formed sheets counted for regular cleaning (count value) is set to a value less than or equal to 10% of the count value. Unlike the configuration where the cumulative number of image-formed sheets for regular cleaning is maintained despite the execution of the cleaning sequence based on an instruction given at freely selected timing, the regular cleaning operation can thus be prevented from being executed immediately after the execution of the cleaning sequence at freely selected timing. This can prevent a drop in usability due to successive cleaning operations in a short period. This can also prevent a drop in productivity due to suspension of an image forming job a plurality of times by execution of a plurality of cleaning operations in a short period.

Next, a third exemplary embodiment will be described. The third exemplary embodiment includes a similar configuration to that of the first exemplary embodiment except that the method for resetting the counter 81 in executing a cleaning operation is different. Similar components are designated by the same reference numerals, and a description thereof will be omitted.

Figure 10:
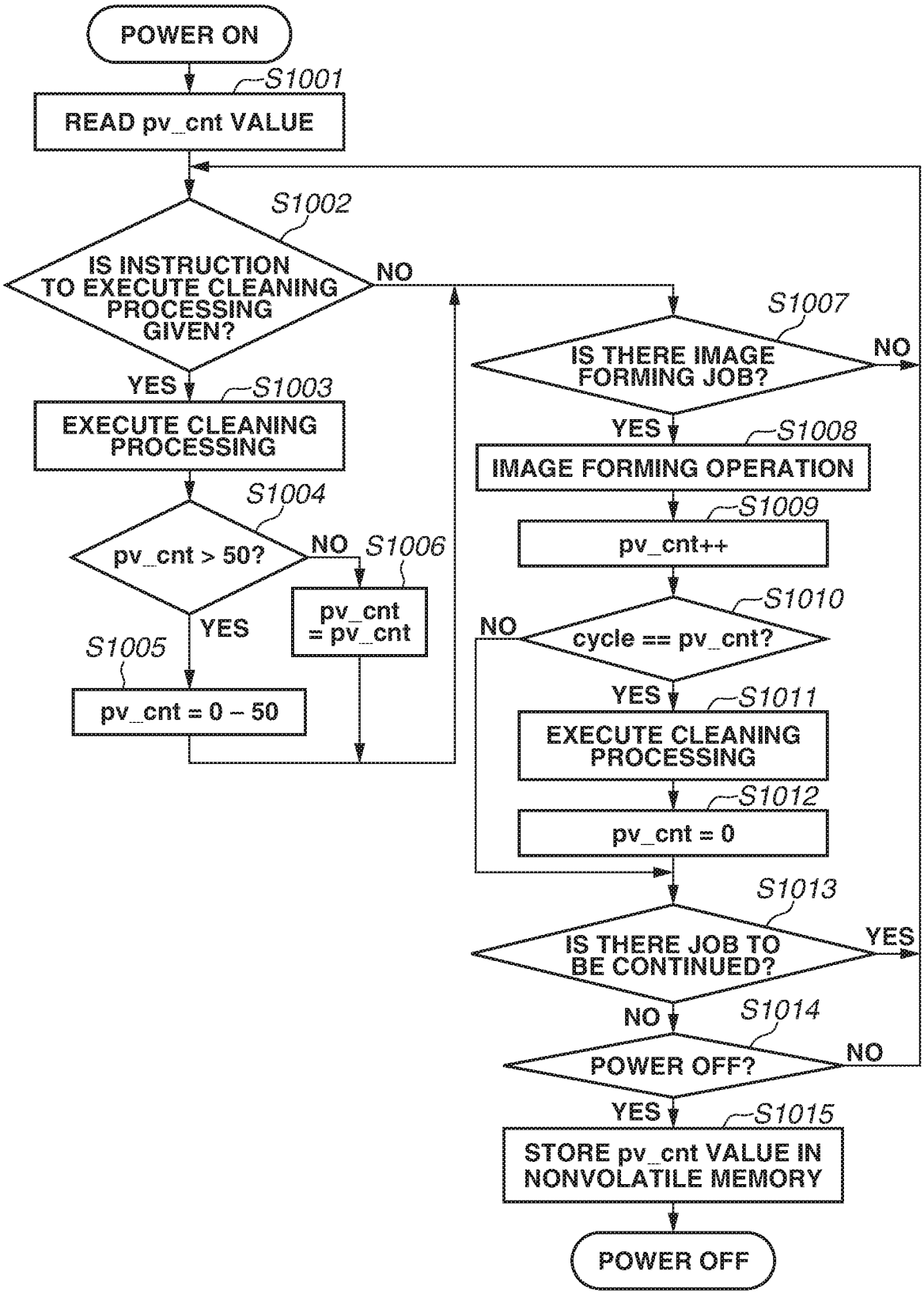
FIG. 10 is a flowchart illustrating a sequence in executing cleaning processing according to a third exemplary embodiment.

In the third exemplary embodiment, when the cleaning sequence is irregularly executed, the count value of the 81 is not reset to 0. Instead, if the count value before the execution of the cleaning processing is greater than 50, the count value of the counter 81 is reduced and reset to a value less than or equal to 50. Such a control method will be described below with reference to FIG. 10. FIG. 10 is a flowchart illustrating the cleaning sequence according to the third exemplary embodiment.

In step S1001, the engine control unit 74 initially reads the count value (referred to as pv_cnt value) from the nonvolatile memory and loads the pv_cnt value into the counter 81.

In step S1002, the engine control unit 74 determines whether an instruction to execute the cleaning processing is given by the operator via the user interface 71. If an instruction to execute the cleaning processing is given by the operator (YES in step S1002), the processing proceeds to step S1003. In step S1003, the engine control unit 74 executes the cleaning processing. In step S1004, the engine control unit 74 determines whether the count value of the counter 81 is greater than 50.

If the count value is greater than 50 (YES in step S1004), the processing proceeds to step S1005. In step S1005, the engine control unit 74 resets the count value to a value less than or equal to 50. The processing proceeds to step S1007. On the other hand, if the count value is less than or equal to 50 (NO in step S1004), the processing proceeds to step S1006. In step S1006, the engine control unit 74 maintains the count value before the execution of the cleaning processing in step S1003. The processing proceeds to step S1007.

In the present exemplary embodiment, it is determined whether the count value is greater than 50 in step S1004. However, the count value may be compared with any numerical value less than the cleaning setting value. Similarly, in step S1005, the count value is set to a value less than or equal to 50. However, such a configuration is not restrictive. The value may be modified based on the numerical value compared in step S1004.

In step S1007, the engine control unit 74 determines whether there is an image forming job in the RAM 501. If there is an image forming job (YES in step S1007), the processing proceeds to step S1008. In step S1008, the engine control unit 74 controls the image formation driving unit 76 to execute an image formation processing. In step S1009, the engine control unit 74 causes the counter 81 to perform a count-up operation (operation for incrementing the count value) by outputting the count signal to the counter 81. The counter 81 increments the count value by one based on the count signal from the engine control unit 74.

In step S1010, the engine control unit 74 compares the cleaning setting value stored in the nonvolatile memory in advance with the count value of the counter 81. If the cleaning setting value and the count value coincide (YES in step S1010), the processing proceeds to step S1011. In step S1011, the engine control unit 74 executes the cleaning processing. In step S1011, if the image forming job started to be executed in step S1008 is still in process, the engine control unit 74 suspends the image forming job and executes the cleaning processing. In step S1012, the engine control unit 74 resets the count value of the counter 81 to 0. On the other hand, if the cleaning setting value and the count value do not coincide (NO in step S1010), the processing proceeds to step S1013. In step S1013, the engine control unit 74 determines whether there is a job to be continued.

The job to be continued refers to a continuation of the image forming job executed in step S1008 (image forming job to be executed after the suspension by the cleaning operation) or the next image forming job stored in the RAM 501 after the one executed in step S1008.

If there is a job to be continued (YES in step S1013), the processing returns to step S1002 and the engine control unit 74 continues the foregoing procedure. On the other hand, if there is no job to be continued (NO in step S1013), the processing proceeds to step S1014. In step S1014, the engine control unit 74 determines whether to power off the image forming apparatus 1.

If the engine control unit 74 determines to not power off the image forming apparatus 1 (NO in step S1014), the processing returns to step S1002 and the engine control unit 74 continues the foregoing procedure. On the other hand, if the engine control unit 74 determines to power off the image forming apparatus 1 (YES in step S1014), the processing proceeds to step S1015. In step S1015, the engine control unit 74 stores the current count value counted by the counter 81 into the nonvolatile memory. The cleaning sequence based on the flowchart of FIG. 10 is ended.

As described above, in the present exemplary embodiment, if the cleaning operation is executed based on an instruction given from the user at freely selected timing regardless of the number of image-formed sheets and the cumulative number of image-formed sheets counted (count value) is greater than 50, the cumulative number of image-formed sheets counted for regular cleaning (count value) is set to less than or equal to 50. Unlike the configuration where the cumulative number of image-formed sheets for regular cleaning is maintained despite the execution of the cleaning processing based on an instruction given at freely selected timing, the regular cleaning processing can thus be prevented from being executed immediately after execution of the cleaning processing at freely selected timing. This can prevent a drop in usability due to successive cleaning operations in a short period. This can also prevent a drop in productivity due to suspension of an image forming job a plurality of times by execution of a plurality of cleaning operations in a short period.

Next, a fourth exemplary embodiment will be described. The fourth exemplary embodiment includes a similar configuration to that of the first exemplary embodiment except that the method for resetting the counter 81 in executing a cleaning operation is different. Similar components are designated by the same reference numerals, and a description thereof will be omitted.

Figure 11:
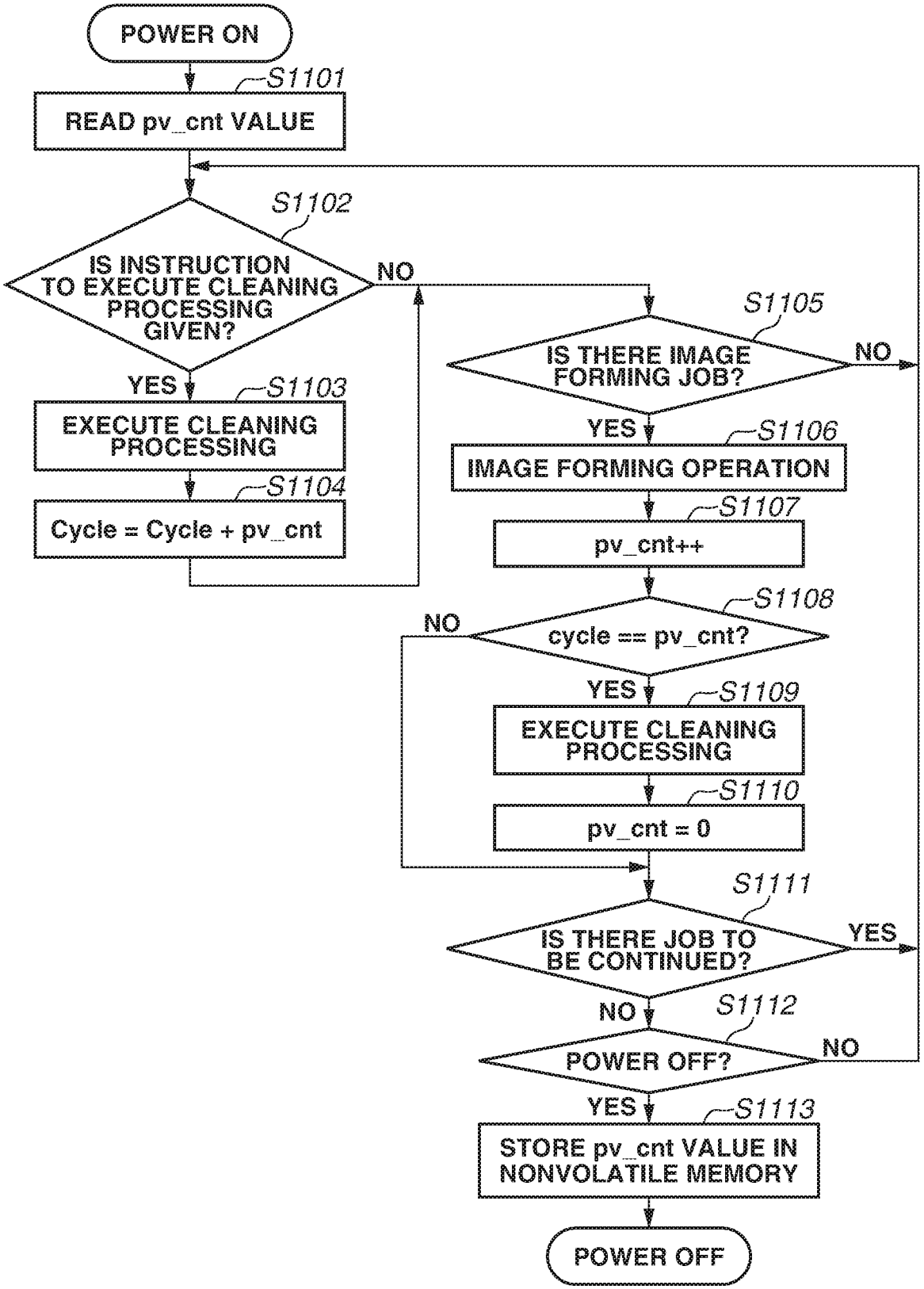
FIG. 11 is a flowchart illustrating a sequence in executing cleaning processing according to a fourth exemplary embodiment.

In the fourth exemplary embodiment, as part of the resetting of the count value, the cleaning set value (predetermined value) is replaced with the sum of the count value when the cleaning sequence is executed based on an instruction given from the user at freely selected timing and the cleaning setting value stored in the nonvolatile memory. Such a control method is described below with reference to FIG. 11. FIG. 11 is a flowchart illustrating the cleaning sequence according to the fourth exemplary embodiment.

In step S1101, the engine control unit 74 initially reads the count value (referred to as pv_cnt value) from the nonvolatile memory and loads the pv_cnt value into the counter 81.

In step S1102, the engine control unit 74 determines whether an instruction to execute the cleaning processing is given by the operator via the user interface 71. If an instruction to execute the cleaning processing is given by the operator (YES in step S1102), the processing proceeds to step S1103. In step S1103, the engine control unit 74 executes the cleaning processing. In step S1104, the engine control unit 74 resets the cleaning setting value by adding the count value before the execution of the cleaning processing to the cleaning setting value stored in the RAM 501 in advance. The processing proceeds to step S1105. If there is no instruction to execute the irregular cleaning processing (NO in step S1102), the processing proceeds to step S1105 (processing for determining whether there is an image forming job).

Suppose, for example, that Cycle (set number of sheets for cleaning) is 500, the pv_cnt value (count value of the counter 81) is 100, and an instruction to execute cleaning processing is given by the user at freely selected timing via the user interface 71. In such a case, Cycle is set to 600 in step S1104.

In step S1105, the engine control unit 74 determines whether there is an image forming job in the RAM 501. If there is an image forming job (YES in step S1105), the processing proceeds to step S1106. In step S1106, the engine control unit 74 controls the image formation driving unit 76 to execute an image formation operation. In step S1107, the engine control unit 74 causes the counter 81 to perform a count-up operation (operation for incrementing the count value) by outputting the count signal to the counter 81. The counter 81 increments the count value by one based on the count signal from the engine control unit 74.

In step S1108, the engine control unit 74 compares the cleaning setting value (denoted as Cycle) stored in the nonvolatile memory in advance with the count value of the counter 81. If the cleaning setting value and the count value coincide (YES in step S1108), the processing proceeds to step S1109. In step S1109, the engine control unit 74 executes the cleaning processing. In step S1109, if the image forming job started to be executed in step S1106 is still in process, the engine control unit 74 suspends the image forming job and executes the cleaning processing. In step S1110, the counter 81 resets the count value of the counter 81 to 0. On the other hand, if the cleaning setting value and the count value do not coincide (NO in step S1108), the processing proceeds to step S1111.

In step S1111, the engine control unit 74 determines whether there is a job to be continued. The job to be continued refers to a continuation of the image forming job executed in step S1106 (image forming job to be executed after the suspension by the cleaning operation) or the next image forming job stored in the RAM 501 after the one executed in step S1106.

If there is a job to be continued (YES in step S1111), the processing returns to step S1102 and the engine control unit 74 continues the foregoing procedure. On the other hand, if there is no job to be continued (NO in step S1111), the processing proceeds to step S1112. In step S1112, the engine control unit 74 determines whether to power off the image forming apparatus 1.

If the engine control unit 74 determines not to power off the image forming apparatus 1 (NO in step S1112), the processing returns to step S1102 and the engine control unit 74 continues the foregoing procedure. On the other hand, if the engine control unit 74 determines to power off the image forming apparatus 1 (YES in step S1112), the processing proceeds to step S1113. In step S1113, the engine control unit 74 stores the current count value counted by the counter 81 into the nonvolatile memory. The cleaning sequence based on the flowchart of FIG. 11 is ended.

As described above, in the present exemplary embodiment, if a cleaning operation is performed based on an instruction given from the user at freely selected timing regardless of the number of image-formed sheets, the cleaning set value is replaced with the sum of the count value when the cleaning sequence is executed and the cleaning setting value stored in the nonvolatile memory.

The regular cleaning operation (cleaning processing executed when the cumulative number of image-formed sheets reaches a predetermined number of sheets) can thus be prevented from being executed immediately after the irregular cleaning operation (cleaning processing executed by an instruction given at freely selected timing regardless of the number of image-formed sheets). This can prevent a drop in usability due to successive cleaning operations in a short period. This can also prevent a drop in productivity due to suspension of an image forming job a plurality of times by execution of a plurality of cleaning operations in a short period.

Next, a fifth exemplary embodiment will be described. The fifth exemplary embodiment includes a similar configuration to that of the first exemplary embodiment except that the methods for counting and resetting the counter 81 in executing a cleaning operation are different. Similar components are designated by the same reference numerals, and a description thereof will be omitted.

Figure 12:
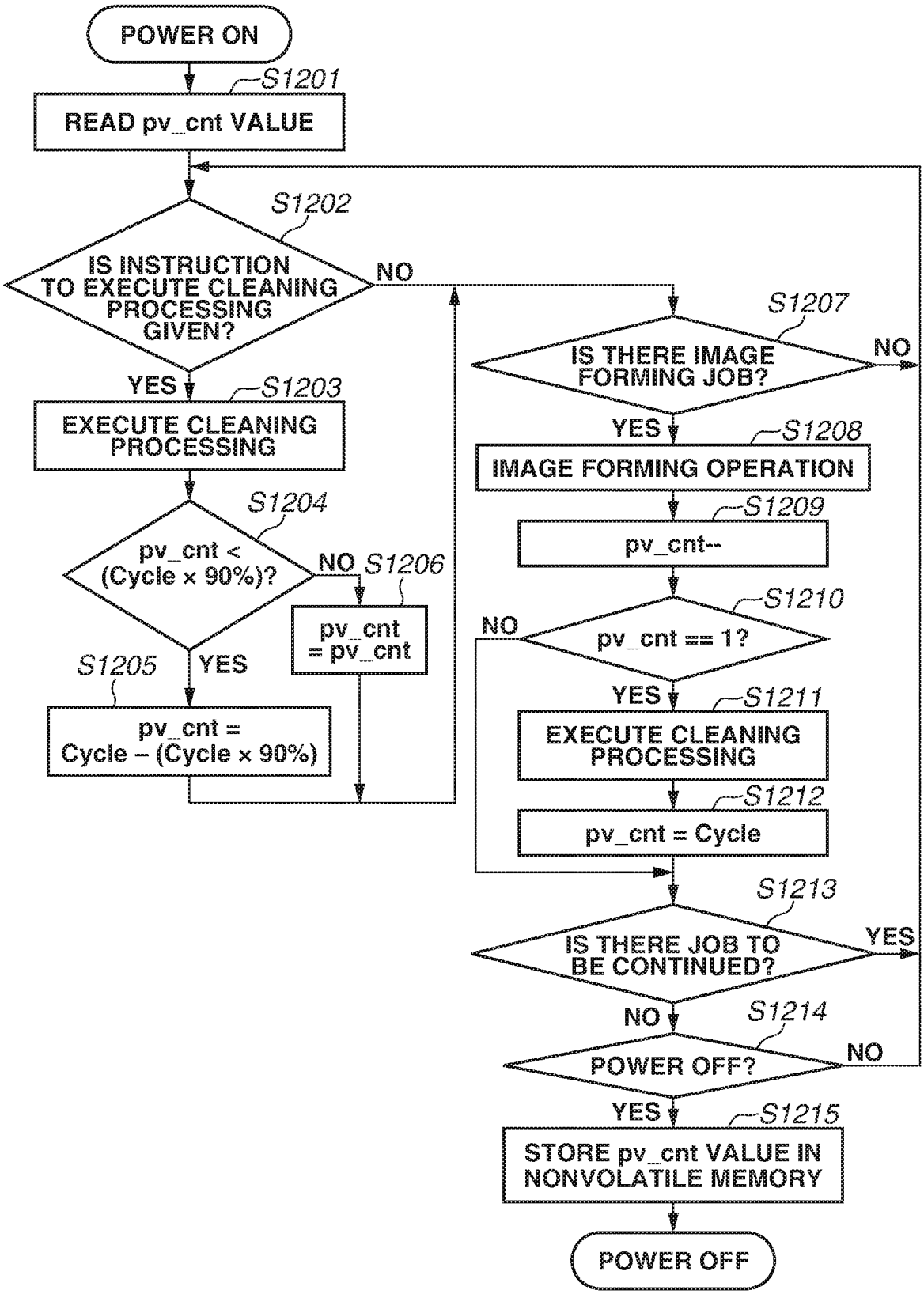
FIG. 12 is a flowchart illustrating a sequence in executing cleaning processing according to a fifth exemplary embodiment.

The fifth exemplary embodiment differs from the first to fourth exemplary embodiments in that the counter 81 is configured to count down (decrement the count value), not count up (increment the count value). Other differences from the first to fourth exemplary embodiments are that the cleaning processing is thus executed not when the count value reaches the set number of sheets for cleaning but when the count value falls to 1, and the count value is reset to the cleaning setting value (predetermined value) after the execution of the cleaning processing. Such a control method will be described below with reference to FIG. 12. FIG. 12 is a flowchart illustrating the cleaning sequence according to the fifth exemplary embodiment.

In step S1201, the engine control unit 74 reads the count value (referred to as pv_cnt value) from the nonvolatile memory and loads the pv_cnt value into the counter 81.

In step S1202, the engine control unit 74 determines whether an instruction to execute the cleaning processing is given by the operator via the user interface 71. If an instruction to execute the cleaning processing is given by the operator (YES in step S1202), the processing proceeds to step S1203. In step S1203, the engine control unit 74 executes the cleaning processing. In step S1204, the engine control unit 74 determines whether the count value of the counter 81 is less than 90% of the cleaning setting value (denoted as Cycle) stored in the nonvolatile memory in advance.

If the count value is less than 90% of the cleaning setting value (YES in step S1204), the processing proceeds to step S1205. In step S1205, the engine control unit 74 resets the count value to a value greater than or equal to 90% of the cleaning setting value. The processing proceeds to step S1207. On the other hand, if the count value is greater than or equal to 90% (NO in step S1204), the processing proceeds to step S1206. In step S1206, the engine control unit 74 maintains the count value before the execution of the cleaning processing in step S1203. The processing proceeds to step S1207.

In the present exemplary embodiment, it is determined whether the count value is less than 90% of the cleaning setting value in step S1204. However, the count value may be compared with any numerical value less than the cleaning setting value. Similarly, in step S1205, the count value is set to a value greater than or equal to 90% of the cleaning setting value. However, such a configuration is not restrictive. The value may be modified based on the numerical value compared in step S1204.

In step S1207, the engine control unit 74 determines whether there is an image forming job in the RAM 501. If there is an image forming job (YES in step S1207), the processing proceeds to step S1208. In step S1208, the engine control unit 74 controls the image formation driving unit 76 to execute an image forming operation. In step S1209, the engine control unit 74 causes the counter 81 to perform a count-down operation (operation for decrementing the count value) by outputting the count signal to the counter 81. The counter 81 decrements the count value by one based on the count signal from the engine control unit 74.

In step S1210, the engine control unit 74 determines whether the count value of the counter 81 is 1. If the count value is 1 (YES in step S1210), the processing proceeds to step S1211. In step S1211, the engine control unit 74 executes the cleaning processing. In step S1211, if the image forming job started to be executed in step S1208 is still in process, the engine control unit 74 suspends the image forming job and executes the cleaning processing. In step S1212, the engine control unit 74 resets the count value of the counter 81 by setting the count value to the cleaning setting value. On the other hand, if the count value does not coincide with 1 (NO in step S1210), the processing proceeds to step S1213. In step S1213, the engine control unit 74 determines whether there is a job to be continued.

The job to be continued refers to a continuation of the image forming job executed in step S1208 (image forming job to be executed after the suspension by the cleaning operation) or the next image forming job stored in the RAM 501 after the one executed in step S1208.

If there is a job to be continued (YES in step S1213), the processing returns to step S1202 and the engine control unit 74 continues the foregoing procedure. On the other hand, if there is no job to be continued (NO in step S1213), the processing proceeds to step S1214. In step S1214, the engine control unit 74 determines whether to power off the image forming apparatus 1.

If the engine control unit 74 determines to not power off the image forming apparatus 1 (NO in step S1214), the processing returns to step S1202 and the engine control unit 74 continues the foregoing procedure. On the other hand, if the engine control unit 74 determines to power off the image forming apparatus 1 (YES in step S1214), the processing proceeds to step S1215. In step S1215, the engine control unit 74 stores the current count value counted by the counter 81 into the nonvolatile memory. The cleaning sequence based on the flowchart of FIG. 12 ends.

As described above, in the present exemplary embodiment, if the cleaning operation is executed based on an instruction given by the user at freely selected timing regardless of the number of image-formed sheets and the count value counted for regular cleaning is less than 90% of the cleaning setting value, the count value is set to greater than or equal to 90% of the cleaning setting value. Unlike the configuration where the cumulative number of image-formed sheets for regular cleaning is maintained despite the execution of the cleaning operation based on an instruction given at freely selected timing, the regular cleaning operation can thus be prevented from being executed immediately after the execution of the irregular cleaning operation at freely selected timing. This can prevent a drop in usability that can be caused by execution of a plurality of cleaning operations in a short period. This can also prevent a drop in productivity due to suspension of an image forming job a plurality of times by the execution of a plurality of cleaning operations in a short period.

In the present exemplary embodiment, it is determined whether to reset the count value based on whether the count value is less than 90% of the set number of sheets for cleaning. If, for example, the cleaning setting value is 1,000, it may be determined whether to reset the count value based on whether the count value is less than 900. Like the foregoing exemplary embodiments, such a configuration can prevent a drop in usability that can be caused by execution of the cleaning operation a plurality of times in a short period.

Other Exemplary Embodiments

In the foregoing exemplary embodiments, the optical scanning device 40 is located below the image forming sections 10 in the vertical direction thereof. However, the optical scanning device 40 may be located perpendicularly above the image forming sections 10. In such a configuration, since the transparent members 42*a* to 42*d* are located above the image forming sections 10, toner or paper dust will not fall from the image forming sections 10. However, scattered toner and paper dust can adhere to the transparent members 42*a* to 42*d*. Foreign substances such as toner and paper dust adhering to the transparent members 42*a* to 42*d* can therefore be removed by providing the cleaning mechanism 51 even in the configuration where the optical scanning device 40 is located perpendicularly above the image forming sections 10.

In the foregoing exemplary embodiments, an image forming job is described to be accepted from the operator via the operation unit 304. However, the foregoing exemplary embodiments are also applicable to a configuration that accepts an image forming job from an external apparatus via a communication line.

A modification of the foregoing exemplary embodiments will be described. In the modification, the number of image-formed sheets up to which the image forming unit is allowed to form an image between the execution of the previous cleaning processing and execution of the next cleaning processing will be referred to as an allowable number of sheets. The allowable number of sheets is a value obtained by subtracting the cumulative number of image-formed sheets at that point in time from the set number of sheets for cleaning Immediately after the execution of the cleaning processing, the allowable number of sheets is the same as the set number of sheets for cleaning. For example, the allowable number of sheets set to the set number of sheets for cleaning immediately after the execution of the cleaning processing then decreases each time an image is formed on a recording medium. If the allowable number of sheets is 0 (the set number of sheets for cleaning is reached), the cleaning processing is executed.

If the allowable number of sheets is greater than 0 (i.e., has not reached the set number of sheets for cleaning) and an instruction to execute the cleaning processing is accepted via the operation unit 304, the cleaning processing is executed. After the execution of the cleaning processing based on the execution instruction, the count value of the counter 81 is reset. Here, an allowable number of sheets greater than 0 will be referred to as a first value (value obtained by subtracting the cumulative number of image-formed sheets at that point in time from the cleaning setting value). The allowable number of sheets after the execution of the cleaning processing based on the execution instruction accepted via the operation unit 304 has a second value (cleaning setting value) greater than the first value. In other words, after the cleaning processing is executed based on the execution instruction accepted via the operation unit 304 in the state where the allowable number of sheets is greater than 0, image formation on recording media is executed with the increased allowable number of sheets. This can prevent a drop in usability due to execution of a plurality of cleaning operations in a short period.

In the foregoing exemplary embodiments, the count value of the counter 81 is reset after the execution of the cleaning processing. However, the count value of the counter 81 may be reset immediately before the execution of the cleaning processing.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-213850, filed Nov. 14, 2018, which is hereby incorporated by reference herein in its entirety.

What is claimed is:

1. An image forming apparatus comprising:

an image forming unit including a photosensitive member and an optical scanning device, the optical scanning device including a transparent member configured to pass laser light for scanning the photosensitive member to outside, the image forming unit being configured to form an image on a recording medium by developing an electrostatic latent image formed on the photosensitive member with toner and transferring a toner image to the recording medium, the electrostatic latent image being formed by scanning with the laser light;

an acquisition unit configured to acquire an image-forming job;

a cleaning mechanism configured to clean the transparent member;

a counter configured to retain a number of recording media on which an image is formed by the image forming unit as a count value;

an operation unit configured to receive an instruction to cause the cleaning mechanism to clean the transparent member from an operator; and a control unit configured to cause the cleaning mechanism to clean the transparent member, wherein, in response to the count value of the counter reaching a predetermined value, the control unit causes the cleaning mechanism to clean the transparent member, and the count value of the counter is reset, wherein, a screen to receive the instruction is displayable by the operation unit during the image forming executed based on an image-forming job acquired by the acquisition unit, wherein the control unit displays the screen according to a prescribed operation operated by a user during the execution of an image forming based on the image-forming job, wherein, in a case where the instruction is input on the screen, the cleaning mechanism cleans the transparent member, and the count value of the counter is reset, wherein during execution of image formation based on the image-forming job acquired by the acquisition unit, in response to the count value of the counter reaching the predetermined value causing the cleaning mechanism to clean the transparent member, the control unit causes the optical scanning device to stop formation of an electrostatic latent image on the photosensitive member based on the image-forming job before causing the cleaning mechanism to clean the transparent member, and causes the optical scanning device to resume the formation of the electrostatic latent image on the photosensitive member based on rest of the image-forming job in response to completion of the cleaning, and wherein during execution of image formation based on the image-forming job acquired by the acquisition unit, in response to the operation unit receiving the instruction to cause the cleaning mechanism to clean the transparent member, the control unit causes the optical scanning device to stop formation of an electrostatic latent image on the photosensitive member based on the image-forming job before causing the cleaning mechanism to clean the transparent member, and causes the optical scanning device to resume the formation of the electrostatic latent image on the photosensitive member based on rest of the image-forming job in response to completion of the cleaning.

2. The image forming apparatus according to claim 1, wherein the control unit is configured to reset the count value retained by the counter after cleaning of the transparent member by the cleaning mechanism is executed.

3. The image forming apparatus according to claim 1, wherein the control unit is configured to reset the count value retained by the counter based on a cleaning sequence that operate the cleaning mechanism executed when the count value reaches the predetermined value.

4. The image forming apparatus according to claim 1, wherein the counter is configured to count the number of recording media on which an image is formed by the image forming unit by counting up the count value, and wherein the control unit is configured to, if the cleaning of the transparent member by the cleaning mechanism is executed, reset the count value retained by the counter to 0.

5. The image forming apparatus according to claim 1, wherein the counter is configured to count the number of recording media on which an image is formed by the image forming unit by counting up the count value, and wherein the control unit is configured to, if the cleaning of the transparent member by the cleaning mechanism is executed, reset the count value retained by the counter to a value less than or equal to 10% of the predetermined value.

6. The image forming apparatus according to claim 5, wherein the control unit is configured to, if the cleaning of the transparent member by the cleaning mechanism is executed based on the execution instruction and the count value retained by the counter is greater than 10% of the predetermined value, reduce the count value retained by the counter to a value less than or equal to 10% of the predetermined value.

7. The image forming apparatus according to claim 1, wherein the counter is configured to count the number of recording media on which an image is formed by the image forming unit by counting down the count value, and wherein the control unit is configured to, if the cleaning of the transparent member by the cleaning mechanism is executed, reset the count value retained by the counter to a value greater than or equal to 90% of the predetermined value.

8. The image forming apparatus according to claim 7, wherein the control unit is configured to, if the cleaning the transparent member by the cleaning mechanism is executed based on the execution instruction and the count value retained by the counter is less than 90% of the predetermined value, increase the count value retained by the counter to the value greater than or equal to 90% of the predetermined value.

9. An image forming apparatus comprising:

an image forming unit including a photosensitive member and an optical scanning device, the optical scanning device including a transparent member configured to pass laser light for scanning the photosensitive member to outside, the image forming unit being configured to form an image on a recording medium by developing an electrostatic latent image formed on the photosensitive member with toner and transferring a toner image to the recording medium, the electrostatic latent image being formed by scanning with the laser light;

an acquisition configured to acquire an image-forming job;

a cleaning mechanism configured to clean the transparent member;

a control unit configured to cause the cleaning mechanism to clean the transparent member when a number of recording media on which an image has been formed by the image forming unit since execution of a last cleaning operation by the cleaning mechanism reaches a predetermined value; and an operation unit configured to receive an instruction to cause the cleaning mechanism to clean the transparent member from an operator, wherein the predetermined value is an allowable number of recording media, which is a number of recording media for which image formation by the image forming unit is allowed before a next cleaning operation by the cleaning mechanism, wherein, a screen to receive the instruction is displayable by the operation unit during the image forming executed based on an image-forming job acquired by the acquisition unit, wherein the control unit displays the screen according to a prescribed operation operated by a user during the execution of an image forming based on the image-forming job, wherein, in a case where the instruction is input on the screen, the cleaning mechanism cleans the transparent member, and the allowable number of recording media is increased, wherein during execution of image formation based on the image-forming job acquired by the acquisition unit, in response to a count value of a counter reaching the predetermined value causing the cleaning mechanism to clean the transparent member, the control unit causes the optical scanning device to stop formation of an electrostatic latent image on the photosensitive member based on the image-forming job before causing the cleaning mechanism to clean the transparent member, and causes the optical scanning device to resume the formation of the electrostatic latent image on the photosensitive member based on rest of the image-forming job in response to completion of the cleaning, and wherein during execution of image formation based on the image-forming job acquired by the acquisition unit, in response to the operation unit receiving the instruction to cause the cleaning mechanism to clean the transparent member, the control unit causes the optical scanning device to stop formation of an electrostatic latent image on the photosensitive member based on the image-forming job before causing the cleaning mechanism to clean the transparent member, and causes the optical scanning device to resume the formation of the electrostatic latent image on the photosensitive member based on rest of the image-forming job in response to completion of the cleaning.

10. The image forming apparatus according to claim 9, wherein the allowable number of recording media is a value obtained by subtracting the number of recording media on which an image is formed by the image forming unit since the cleaning of the transparent member by the cleaning mechanism is executed last time from the predetermined value, and wherein the control unit is configured to, if the allowable number of recording media is 0, execute the cleaning of the transparent member by the cleaning mechanism.

11. The image forming apparatus according to claim 9, wherein the control unit is configured to, if the allowable number of recording media becomes 0 during execution of an image-forming job on a recording medium by the image forming unit, suspend the job, execute the cleaning of the transparent member by the cleaning mechanism, and resume the job after completion of the cleaning of the transparent member by the cleaning mechanism.

12. The image forming apparatus according to claim 1, wherein the image forming unit includes a developing device configured to develop the electrostatic latent image formed on the photosensitive member, and wherein the optical scanning device is located below the developing device in a vertical direction of the image forming apparatus.

13. The image forming apparatus according to claim 9, wherein the image forming unit includes a developing device configured to develop the electrostatic latent image formed on the photosensitive member, and wherein the optical scanning device is located below the developing device in a vertical direction of the image forming apparatus.

14. The image forming apparatus according to claim 1, further comprising:

a developing device configured to develop the electrostatic latent image formed on the photosensitive member with the toner;

another photosensitive member different than the photosensitive member;

another developing device configured to develop an electrostatic latent image formed on the another photosensitive member with toner of different color than the developing device; and another transparent member on the optical scanning device, the another transparent member being configured to pass laser light for scanning the another photosensitive member to outside, wherein the cleaning mechanism includes:

a cleaning member in contact with the transparent member;

another cleaning member in contact with the another transparent member;

a holding unit configured to hold the cleaning member and the another cleaning member; and a moving unit configured to move the holding unit along a scanning direction of the laser light by the optical scanning device.

15. The image forming apparatus according to claim 14, wherein the moving unit includes:

a wire connected to the holding unit at a position between the cleaning member and the another cleaning member, the wire being configured to move the holding unit in the scanning direction;

a plurality of pulleys between which the wire is stretched such that the wire passes between the transparent member and the another transparent member;

a take-up drum configured to take up the wire; and a motor configured to drive the take-up drum to rotate such that the holding unit reciprocally moves in the scanning direction.

16. The image forming apparatus according to claim 9, further comprising:

a developing device configured to develop the electrostatic latent image formed on the photosensitive member with the toner;

another photosensitive member different than the photosensitive member;

another developing device configured to develop an electrostatic latent image formed on the another photosensitive member with toner of different color than the developing device; and another transparent member on the optical scanning device, the another transparent member configured to pass laser light for scanning the another photosensitive member to outside, wherein the cleaning mechanism includes:

a cleaning member in contact with the transparent member;

another cleaning member in contact with another transparent member;

a holding unit configured to hold the cleaning member and the another cleaning member; and a moving unit configured to move the holding unit along a scanning direction of the laser light from the optical scanning unit.

17. The image forming apparatus according to claim 16, wherein the moving unit includes:

a wire connected to the holding unit at a position between the cleaning member and the another cleaning member, the wire being configured to move the holding unit in the scanning direction;

a plurality of pulleys between which the wire is stretched such that the wire passes between the transparent member and the another transparent member;

a take-up drum configured to take up the wire; and a motor configured to drive the take-up drum to rotate such that the holding unit reciprocates in the scanning direction.

18. The image forming apparatus according to claim 1, wherein the operation unit displays a screen indicating that the cleaning operation has been completed according to the completion of the cleaning operation by the cleaning mechanism.

19. The image forming apparatus according to claim 9, wherein the operation unit displays a screen indicating that the cleaning operation has been completed according to the completion of the cleaning operation by the cleaning mechanism.

* * * * *